US009315354B2

(12) United States Patent
Tommasi

(10) Patent No.: US 9,315,354 B2
(45) Date of Patent: Apr. 19, 2016

(54) APPARATUS AND METHOD FOR FEEDING STACKS OF TISSUES OR SIMILAR FOLDED PRODUCTS TO AN AUTOMATIC PACKAGING SYSTEM

(75) Inventor: Renzo Tommasi, Pistoia (IT)

(73) Assignee: RENT S.R.L., Massa e Cozzile (Pistoia) (IT)

( * ) Notice: Subject to any disclaimer, the term of this patent is extended or adjusted under 35 U.S.C. 154(b) by 357 days.

(21) Appl. No.: 13/814,173

(22) PCT Filed: Aug. 9, 2011

(86) PCT No.: PCT/IB2011/053548

§ 371 (c)(1),
(2), (4) Date: Apr. 9, 2013

(87) PCT Pub. No.: WO2012/020374

PCT Pub. Date: Feb. 16, 2012

(65) Prior Publication Data

US 2013/0209215 A1 Aug. 15, 2013

(30) Foreign Application Priority Data

Aug. 10, 2010 (IT) ..... FI2010A0177

(51) Int. Cl.

| | |
|---|---|
| ***B65H 31/30*** | (2006.01) |
| ***B65H 29/40*** | (2006.01) |
| ***B65B 11/38*** | (2006.01) |
| ***B65B 25/14*** | (2006.01) |
| ***B65B 35/46*** | (2006.01) |
| ***B65H 31/06*** | (2006.01) |
| ***B65H 33/18*** | (2006.01) |

(52) U.S. Cl.

CPC ..... *B65H 29/40* (2013.01); *B65B 11/38* (2013.01); *B65B 25/145* (2013.01); *B65B 35/46* (2013.01); *B65H 31/06* (2013.01); *B65H 31/3027* (2013.01); *B65H 31/3063* (2013.01); *B65H 31/3072* (2013.01); *B65H 31/3081* (2013.01); *B65H 33/18* (2013.01); *B65H 2301/4223* (2013.01); *B65H 2301/42146* (2013.01); *B65H 2404/656* (2013.01); *B65H 2406/323* (2013.01); *B65H 2701/1924* (2013.01)

(58) Field of Classification Search

CPC ..... B65B 11/38; B65B 35/46; B65B 25/145; B65H 2404/656; B65H 29/40; B65H 31/06; B65H 31/3027; B65H 31/3063; B65H 31/3072; B65H 31/3081; B65H 33/18; B65H 2301/42146; B65H 2301/4223; B65H 2406/323; B65H 2701/1924

USPC ..... 414/790.3, 802

See application file for complete search history.

(56) References Cited

U.S. PATENT DOCUMENTS 3,445,980 A * 5/1969 Salomon ..... 53/448
4,221,287 A * 9/1980 Seragnoli ..... 198/418

(Continued)

FOREIGN PATENT DOCUMENTS

DE 2461002 B1 4/1976
JP 54-088563 A 7/1979

*Primary Examiner* — Saul Rodriguez
*Assistant Examiner* — Lynn Schwenning
(74) *Attorney, Agent, or Firm* — Lucas & Mercanti, LLP.

(57) ABSTRACT

An apparatus for feeding tissues or similar folded paper articles towards an automatic packaging system, comprises means for forming stacks of articles with one or more sets of separating wheels, and means for radially ejecting and feeding the stacks to the packaging system; the ejection means comprise at least one ejection device with two or more pushing members inserted between a wheel and the other; article stop means are adjustable in a direction that is substantially tangential with respect to the separating wheel, and orthogonal with an ejection direction.

20 Claims, 25 Drawing Sheets

(56) References Cited

U.S. PATENT DOCUMENTS 4,357,126 A * 11/1982 Kidd et al. ..... 414/790.3
5,459,979 A * 10/1995 Tommasi ..... 53/439
2001/0032775 A1* 10/2001 Guglielmo et al. ..... 198/732
2002/0134053 A1* 9/2002 Lohrey et al. ..... 53/447
2003/0082044 A1* 5/2003 Gendron et al. ..... 414/789.9
2006/0108198 A1* 5/2006 Guidetti ..... 198/431

* cited by examiner 9
8

8

5
5a 5
5a

M1
11
8
5
3
6
7
6a
13
15
13
12
14
10
1
2
4

APPARATUS AND METHOD FOR FEEDING STACKS OF TISSUES OR SIMILAR FOLDED PRODUCTS TO AN AUTOMATIC PACKAGING SYSTEM

CROSS-REFERENCE TO RELATED APPLICATIONS

This application is a 371 of PCT/IB2011/053548, filed Aug. 9, 2011, which claims the benefit of Italian Patent Application No. FI2010A000177, filed Aug. 10, 2010, the contents of each of which are incorporated herein by reference.

FIELD OF THE INVENTION

The present invention concerns the high speed packaging of folded tissues such as napkins, handkerchiefs and the like. More specifically it concerns an apparatus and method for continuously feeding such products, arranged in stacks and coming from folding machines, to packaging machines such as revolving drum machines arranged downstream.

BACKGROUND OF THE INVENTION

The operation of such a kind of machines, arranged and working between the folding system and the packaging system, is very complex due to the nature of the material normally used (highly pliable tissue paper), and above all to the high working speed that is imposed.

These machines or apparatus have substantially the features described e.g. in European Patent EP537125, in the name of the same present applicant. They comprise belt or chain conveyor systems that feed single folded article from the outlet of the folding machines towards an accumulation and counting unit having the function of grouping the articles in stacks, each including a pre-settable number of pieces, controllable as needed. The accumulation and counting unit comprises a series of adjacent and mutually spaced collecting discs (variable in number depending on the size of the machine, revolving in a mutually integral fashion and provided with pockets, for collecting single folded products, the pockets being in the shape of curvilinear tangential laminations, adjacent to one another and partially superimposed, in such a way that each pocket, indeed defined by the spacing between to consecutive laminations, is adapted to house a single folded article.

The collecting discs cooperate tangentially with separating wheels revolving in a step-by-step fashion, having radially projecting blades, suitably spaced along the periphery of the wheel so that; between two consecutive ranks of adjacent blades (each rank being determined by a plurality of coplanar blades, each on a respective wheel), a housing is formed in which a group or stack of articles is accumulated. Such articles are taken by the blades from the collecting discs, following to insertion of the same blades in the space between a disc and an adjacent one.

Downstream of the accumulation and separating wheels, transportation means are adapted to withdraw the accumulated groups of articles and to convey them towards the packaging system. The transportation means, according to the known art, can adopt different arrangements, such as chain or slider arrangements.

As mentioned, the problems affecting the known apparatus essentially result from the difficulty of ensuring reliable performances in high-speed operation, as imposed by more and more demanding productive requirements. In this respect, the flexibility, speed and reliability of the known solutions are not fully satisfactory, and indeed are often the cause of production stops, in turn causing wastes of material and malfunctions of the packaging machines.

There is therefore a strong need for an integrated system for the accumulation, counting and transportation of the product from the folding machine, which is flexible, reliable, highly productive and with no restraining limits in the working speed.

SUMMARY OF THE INVENTION

The object of the present invention is therefore to provide a feeding apparatus of stacks of folded products, generally of the kind described above, that attains a constant and reliable feed of variably sized product stacks, overcoming the present limits in the working speed, with relatively simple and safe constructive solutions.

According to the invention, this object is achieved with an apparatus and method for feeding stacks of tissues or similar folded paper products towards an automatic packaging system, having the essential features defined by the attached claims.

BRIEF DESCRIPTION OF THE DRAWINGS

The characteristics and advantages of the apparatus and method for feeding stacks of tissues or similar folded paper products towards an automatic packaging system according to the present invention will be apparent from the following description of embodiments thereof, made purely for exemplifying purposes and not limitative, with reference to the attached drawings wherein.

DETAILED DESCRIPTION OF THE INVENTION

Figures 1, 1A, 1B, 1C, 1D:
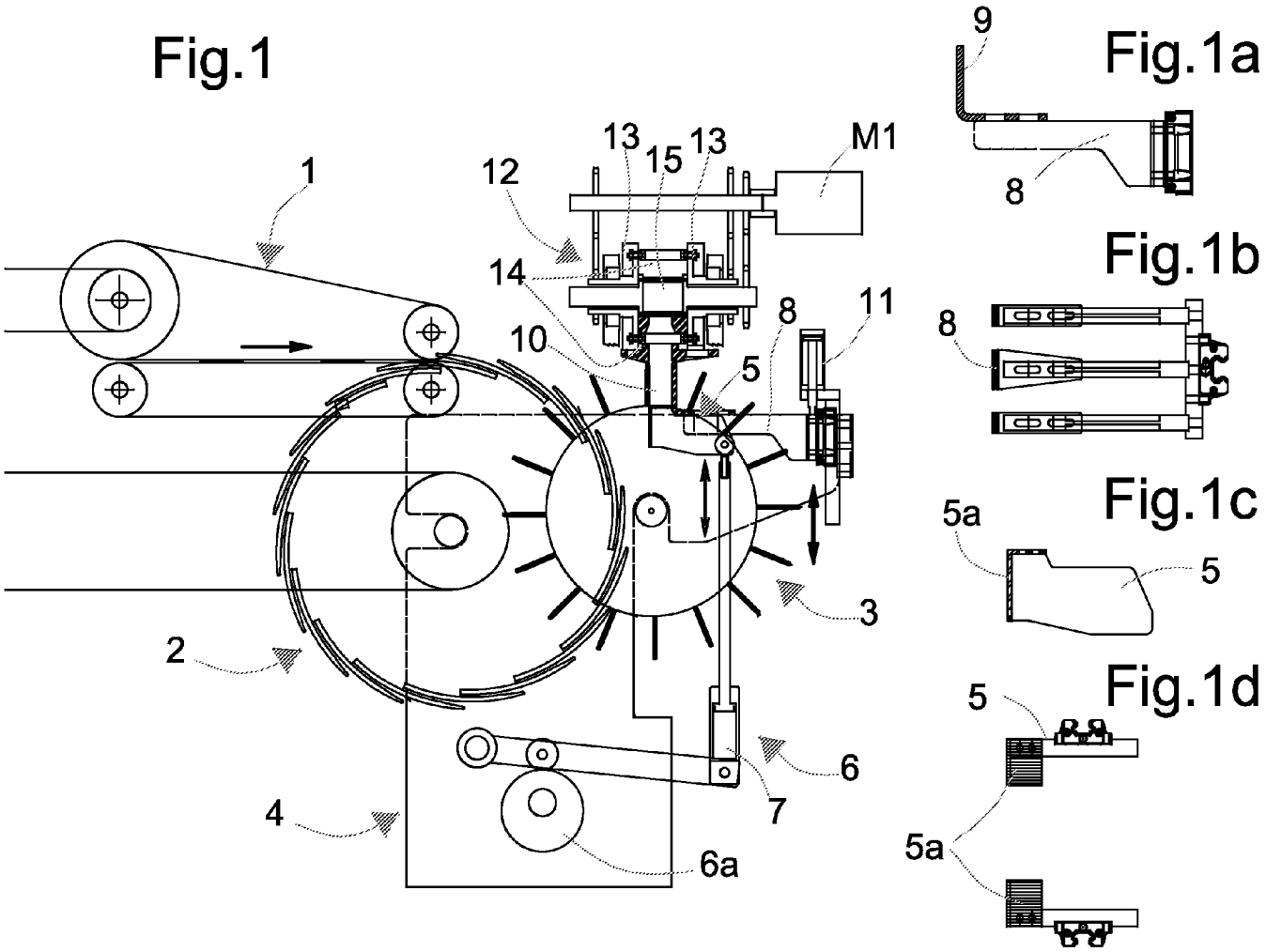
FIG. 1 is a schematic side view of a feeding apparatus according to the invention, in a first embodiment.
FIGS. 1*a* and 1*b* are views respectively from one side and from the above of a product stop device for stopping the product during the formation of the stacks in the apparatus of FIG. 1, the device being represented in isolation.
FIGS. 1*c* and 1*d* are views respectively from one side and from the above of a stack ejection device for ejecting the stacks from the accumulation and separating wheels of the apparatus of FIG. 1, also this device being represented in isolation.

Referring to the above figures, and namely to the FIG. from 1 to 12, a feeding machine or apparatus according to a first embodiment of the invention is arranged at the outlet of a folding machine (not shown, being indeed of a known kind), and comprises pairs of product supplying belts 1 feeding the product to a plurality of collecting discs 2, normally three side by side discs for each workflow channel. A set of product separating and accumulating wheels 3, two for each workflow channel according to the present example, cooperates as in the known art with the collecting discs 2, a support structure or frame 4 being provided for supporting the discs and the wheels. The depicted exemplifying embodiment is therefore an apparatus with two adjacent workflow channels or lines. Each wheel has a distribution of radial blades 31. Two mutually aligned blades of respective adjacent wheels form a blade rank, the blades in each rank being kept mutually coplanar in operation.

A system for radially ejecting the stacks from the separating wheels 3 is generally indicated at 5, and is controlled by a crank and rod control device 6 driven, on the crank, by a driving camshaft with cams 6*a*. A single camshaft controls the multiple side by side workflow channels (as further clarified hereafter) and designed so as to obtain a kinematic law adapted to allow the operation of the system as described further on. The device 5, as noticeable in FIGS. 1*c* and 1*d*, is essentially formed, for each workflow channel, by two or more pushing members 5*a* that act on the stacks in an ejection station, moving along a radial ejection direction. Namely, the pushing members are arranged between one wheel and the other, in a position closer to the centre of the wheels, with respect to the periphery on which the articles are accumulated.

The crank and rod control device 6 comprises, for each rod-crank set controlling the pushing members, an unlocking system 7, useful in case of product jams as better clarified hereafter. A system for stopping the product during the formation of the stacks comprises, again for each single workflow channel, a bracket 8 and a number of stop members 9 adjustable in a longitudinal direction of the bracket, that is a direction substantially tangential with respect to the separating wheels 3 and orthogonal with the ejection direction. The stop members 9 have the function of creating, in a step of ejection of the products from the separating wheels, a containment recess 10, adjustable as a function of the number of articles in each stack. The bracket 8 is movable according to a direction parallel with the ejection direction, driven by an actuator 11, normally a pneumatic actuator, in turn adapted to allow for the product outlet in case of malfunctions, without causing jams in the system, and to be restored to running order without production stops.

Figure 2:
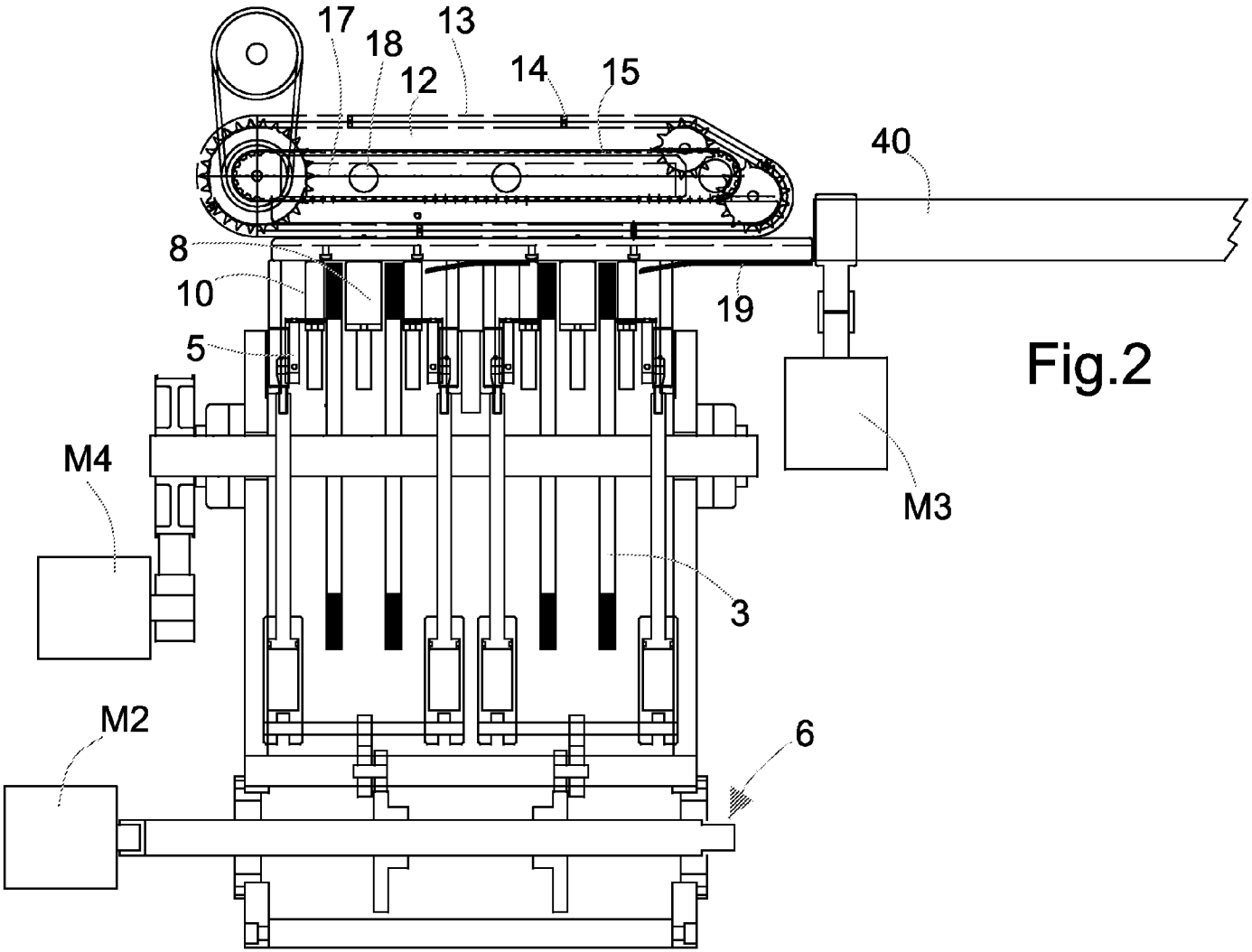
FIG. 2 is a front view of the apparatus of FIG. 1.
Figure 3C:
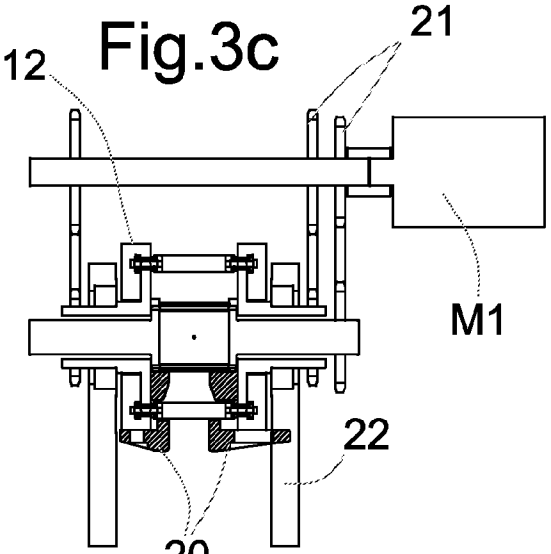
FIGS. 3*a*, 3*b* and 3*c* are views respectively from the front, from the above and from one side of a transport unit of the apparatus of FIG. 1, also this device being represented in isolation.
Figure 3A:
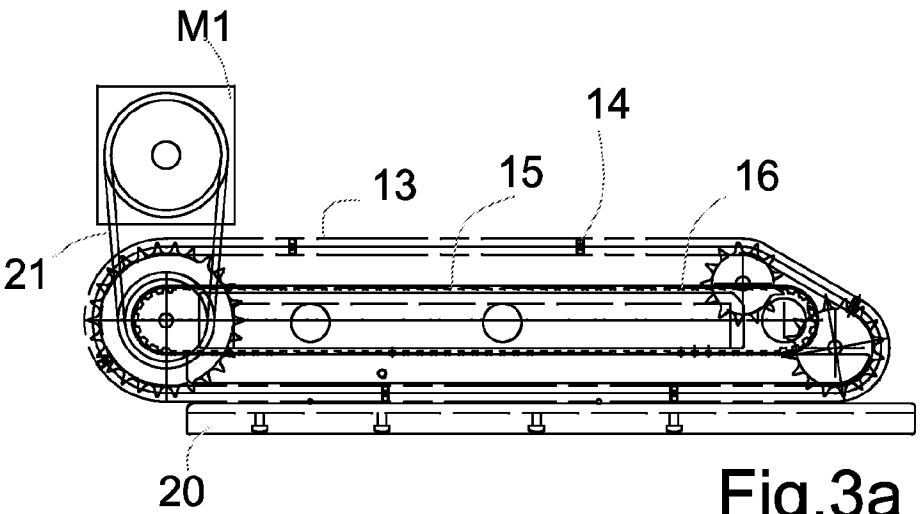
Figure 3B:
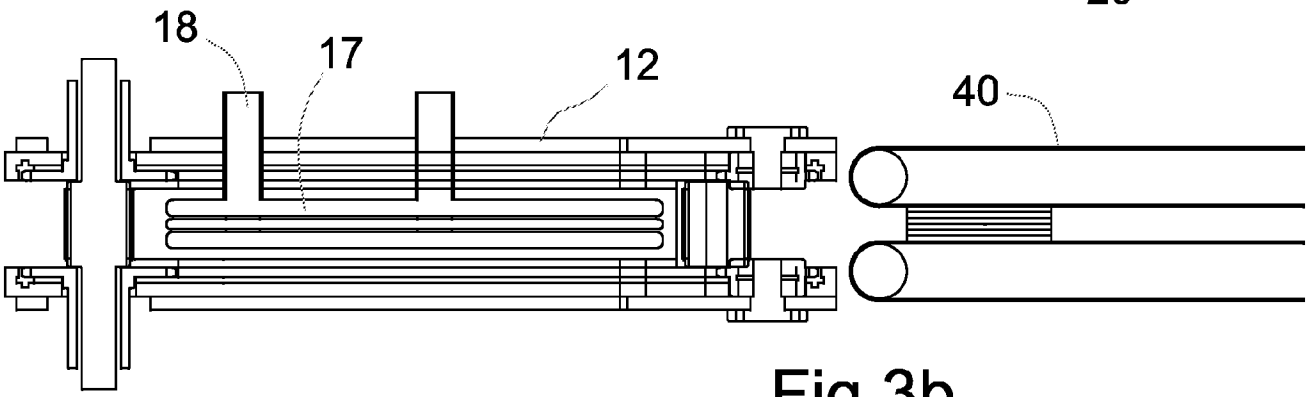
Figure 4:
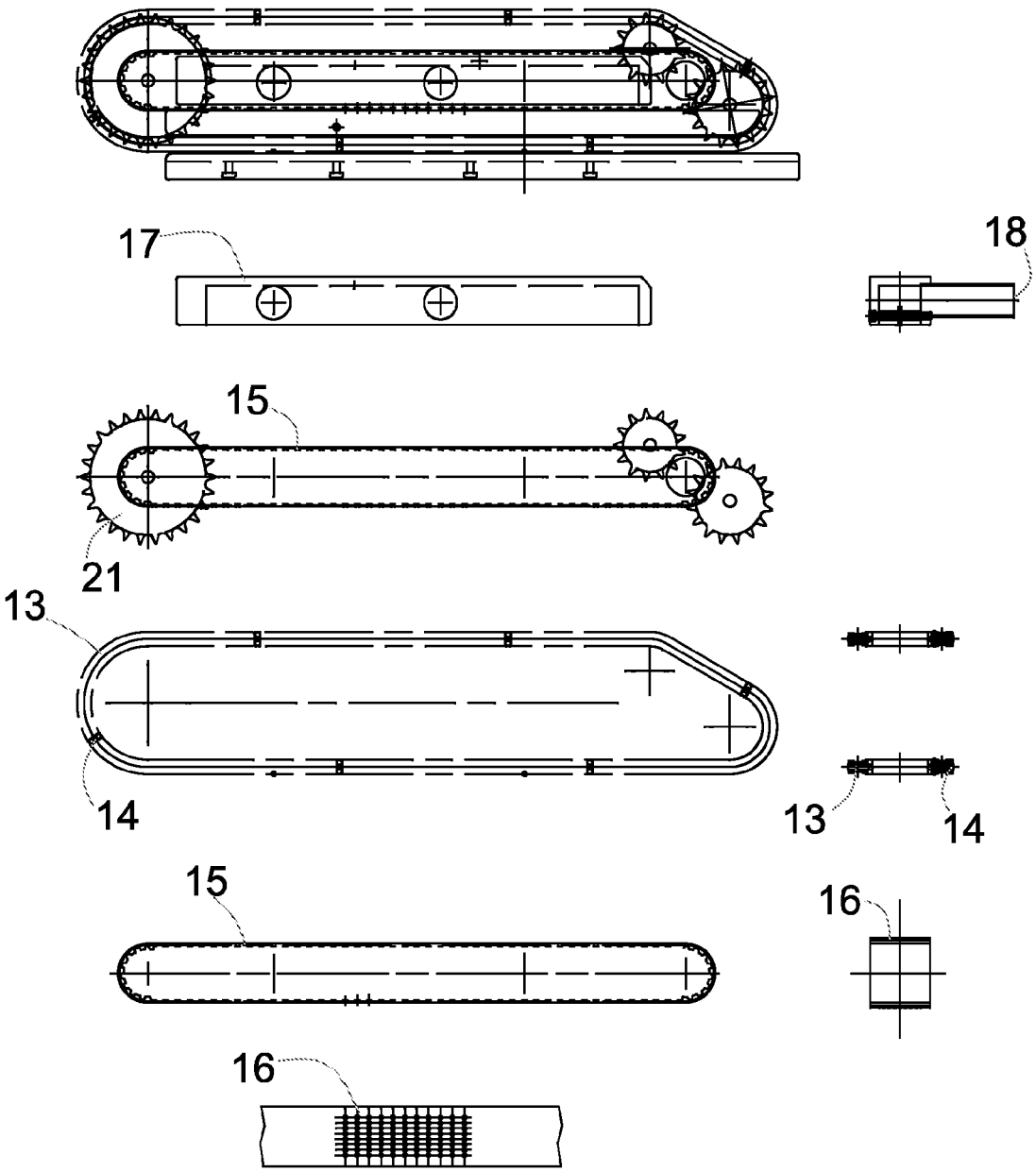
FIG. 4 is a front exploded view of the transport unit of the previous figures.

In FIGS. 2, 3*a*, 3*b* there can be particularly noticed a transport system 12 for transporting the stacks, once radially ejected from the separating wheels, to feeding belts 40 carrying the products to the packaging machine, not shown. The transport system 12 works along a transport direction parallel with the rotation axis of the separating wheels.

The system 12 comprises a pair of mutually spaced chains 13, and a plurality of crosspieces 14 extending between the chains to mechanically interfere with the stacks and thus urge them along the transport directions. It is important to notice that, according to the invention, the transport system can extend axially (that is parallel with the rotation axis of the separating wheels 3) so as to convey the stacks ejected by a plurality of side by side stack forming workflow channels, like the two in the depicted example. Accordingly, multiple channels are conveyed to a single outlet channel feeding the packaging machine. The number of workflow channels coming upstream from the folding machine can vary as a function of the speed of this machine, as well as of the speed of the downstream packaging machine. Moreover, the stacks can be ejected vertically upwards, as in the presently considered example, or according to different arrangements, depending on the type of packaging machine employed, with the support of the stacks by the separating wheels 3 being in any case assisted by gravity.

Considering now again specifically the transport system, a conveyor belt 15 is operatively arrange in the space between the two chains 13, winding around deviation rollers having a reduced width, with respect to the width of the path of the chains. The belt 15 is provided with holes 16, uniformly distributed and communicated with a vacuum source (not shown) via an inner chamber 17 with slots, acting also as a support element of the belt, and a manifold 18. The belt 15 supports therefore the stacks on a top side thereof, so that they are kept in adhesion by suction to the same belt during the whole transport run towards the belts 40 directed to the packaging machine.

One can also notice a series of guides 19 and 20 extending in turn along the transport direction, for keeping the stacks tightly restrained in the proximity of the lower side, i.e. the side close to the separating wheels 3 from which the same stacks are ejected. More in detail, the guides 20 provide a lateral containment to the stacks, while the guide 19 supports the same stacks in the vertical direction when the suction ceases (the transport belt 15 ends in fact its development before the chains 13. Finally, the reference numeral 22 indicates support elements of the transport system 12.

A motor M1 drives, via a transmission 21 (FIGS. 3*a* and 3*c*) the chains 13 and the transport belt 15, in a synchronized manner with a motor M2 driving the rotation of the camshaft 6*e* of the control device 6 of the ejection system, and with a motor M3 driving the belts 40 directed to the packaging machine. A further motor M4 (FIG. 2) brings into rotation the separating wheels 3.

Referring now in particular to FIGS. 5 to 12, the operative behavior of the apparatus according to the invention will be elucidated, with the indication, besides to the separating blades 31 of the wheels 3, of product stacks 30*a*, 30*b* under formation/ejection.

Figure 5:
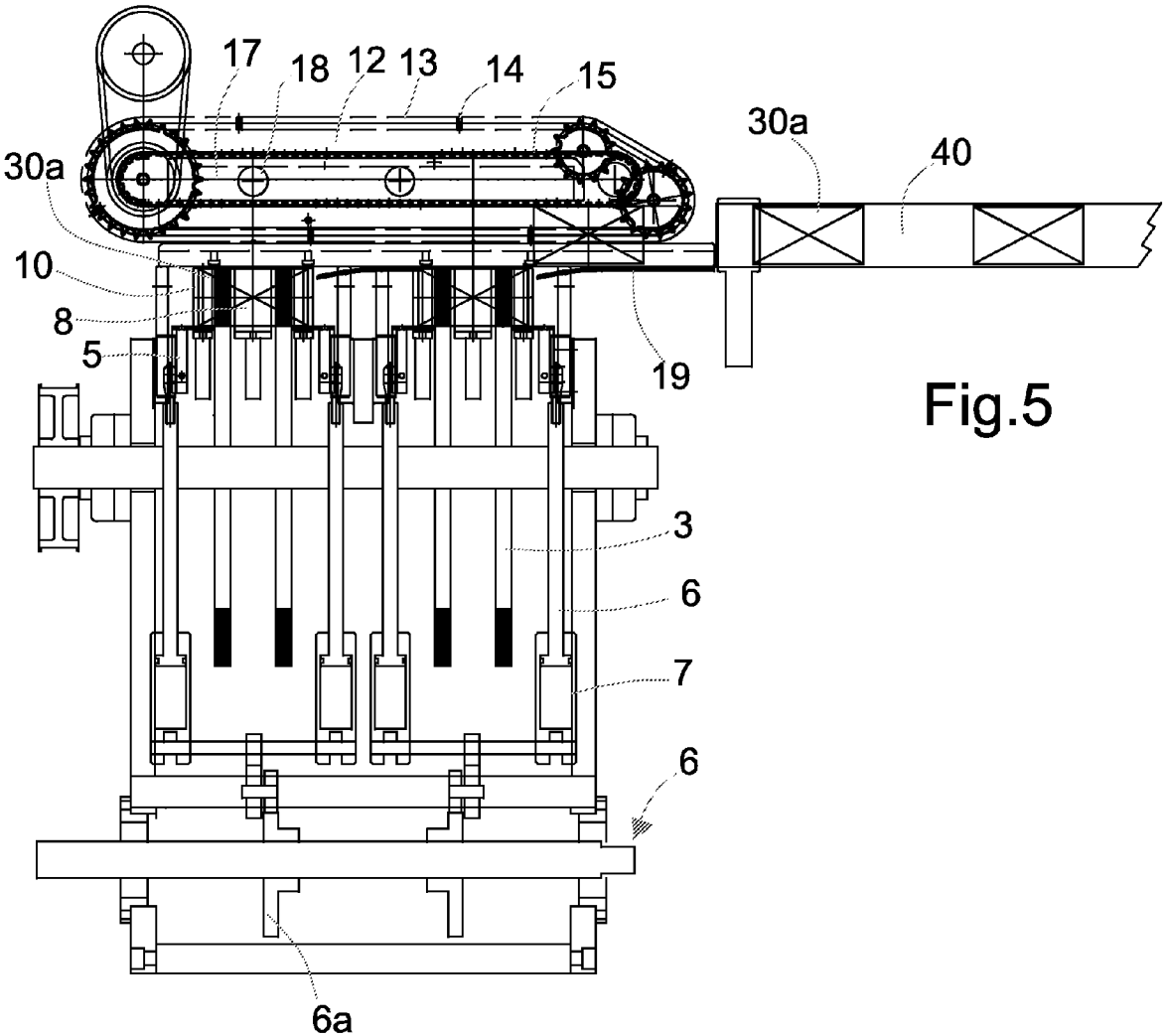
FIGS. 5, 5*a* (front and side views, respectively) to 10, 10*a* (front and side views, respectively) show successive formation steps of a product stack and subsequent progress towards the packaging machine downstream, with the apparatus according to the previous figures.
Figure 5A:
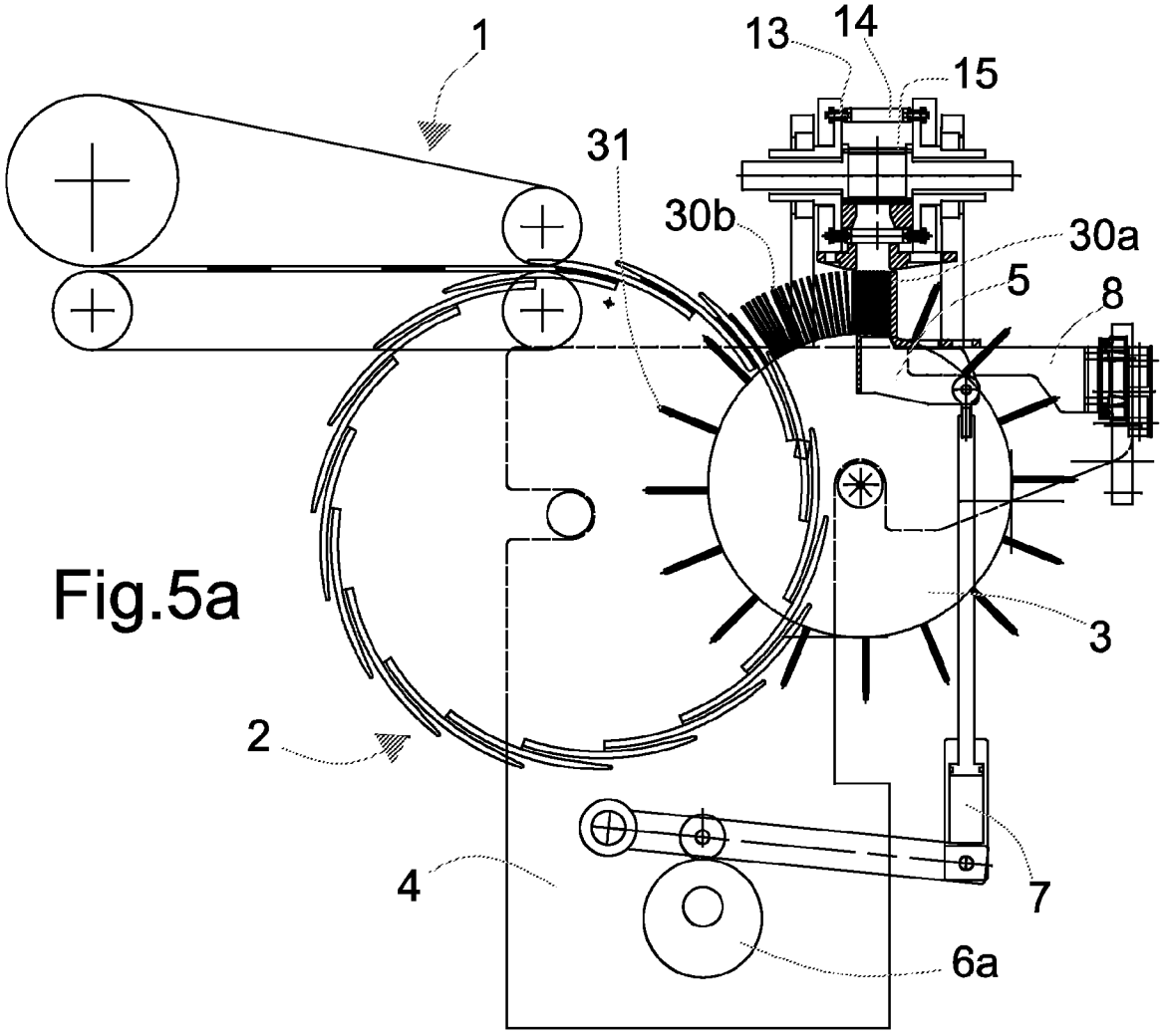
Figure 10:
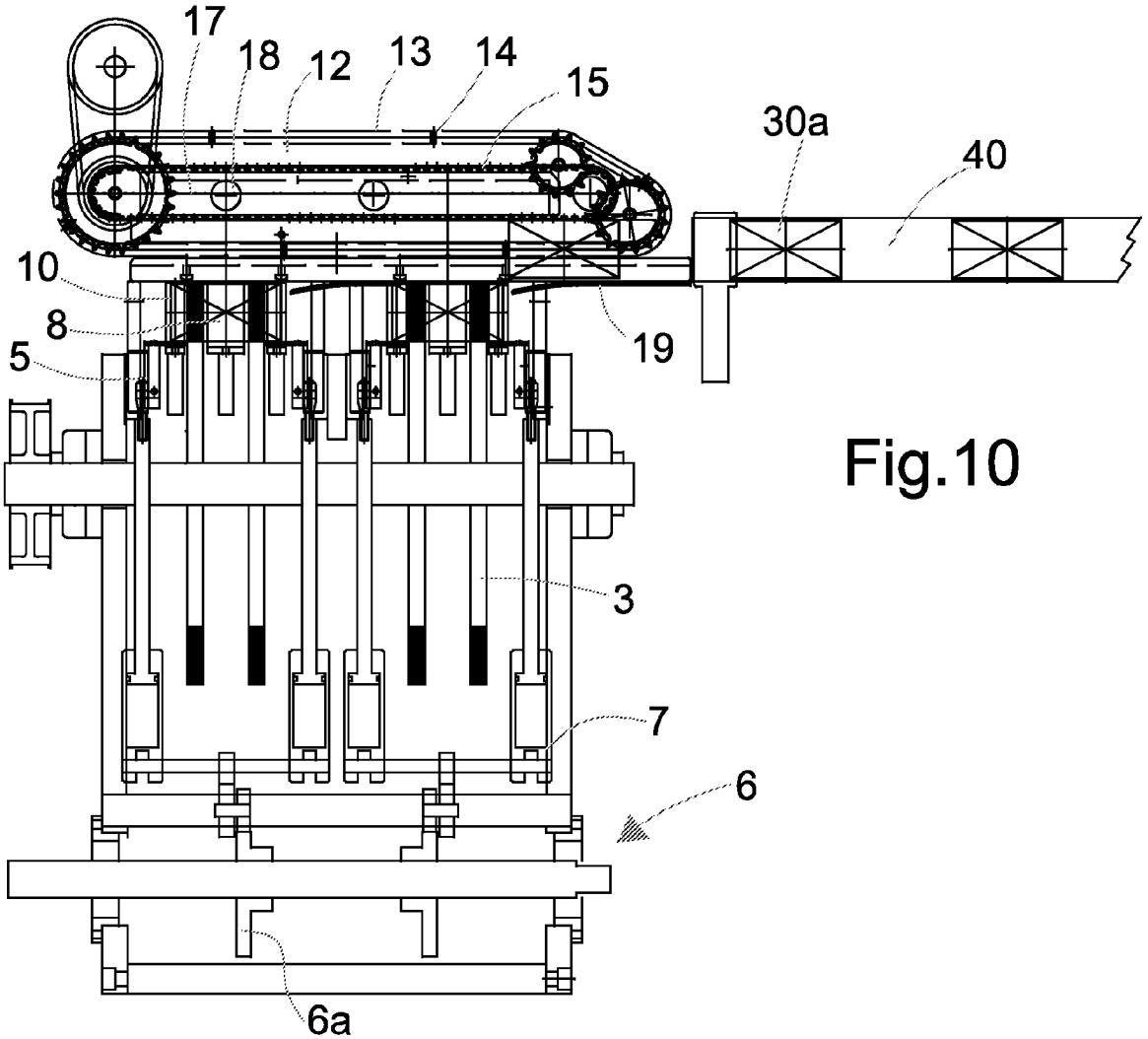
Figure 10A:
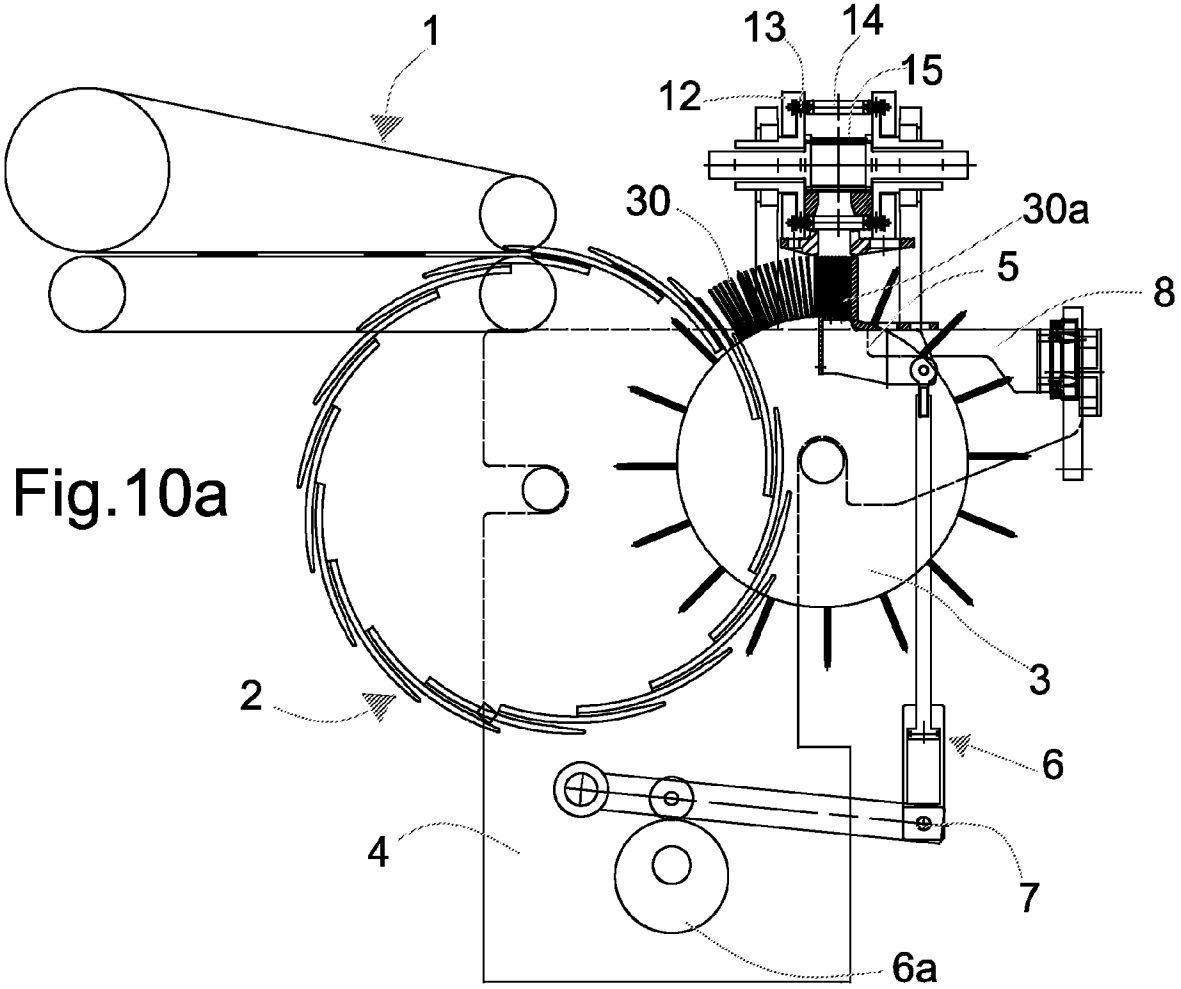

For the time being, starting from FIG. 5*a* and then on the corresponding subsequent figures to FIG. 10*a*, the stack accumulation and ejection procedure by the separating wheel 3 will be followed. In FIG. 5*a* it can be noted that the product supplying belts 1 coming from the folding machine work at a constant speed, feeding single folded articles to the pockets of the collecting discs 2, in turn driven into rotation at a constant speed.

The separating wheels 3 have a step by step motion at a variable speed as a function of the number of articles that each stack must include. As the rotation speed varies, the period consequently varies between the insertion of a rank of separating blades 31 and the insertion of a subsequent rank between the collecting discs 2, and accordingly the number of articles accumulated between the two subsequent blade ranks varies. Such variable speed can be programmed through a numerical control system with a kinematic law that indeed provides for accelerations and decelerations of the rotation.

In particular in the step of FIG. 5*a* the system has formed a product stack 30*a* that is positioned in an ejection area, that is the area in which the ejection device 5 works. In this step the separating wheels 3 reach an almost null speed, to let the ejection devices 5 properly push the stacks out.

Figure 6:
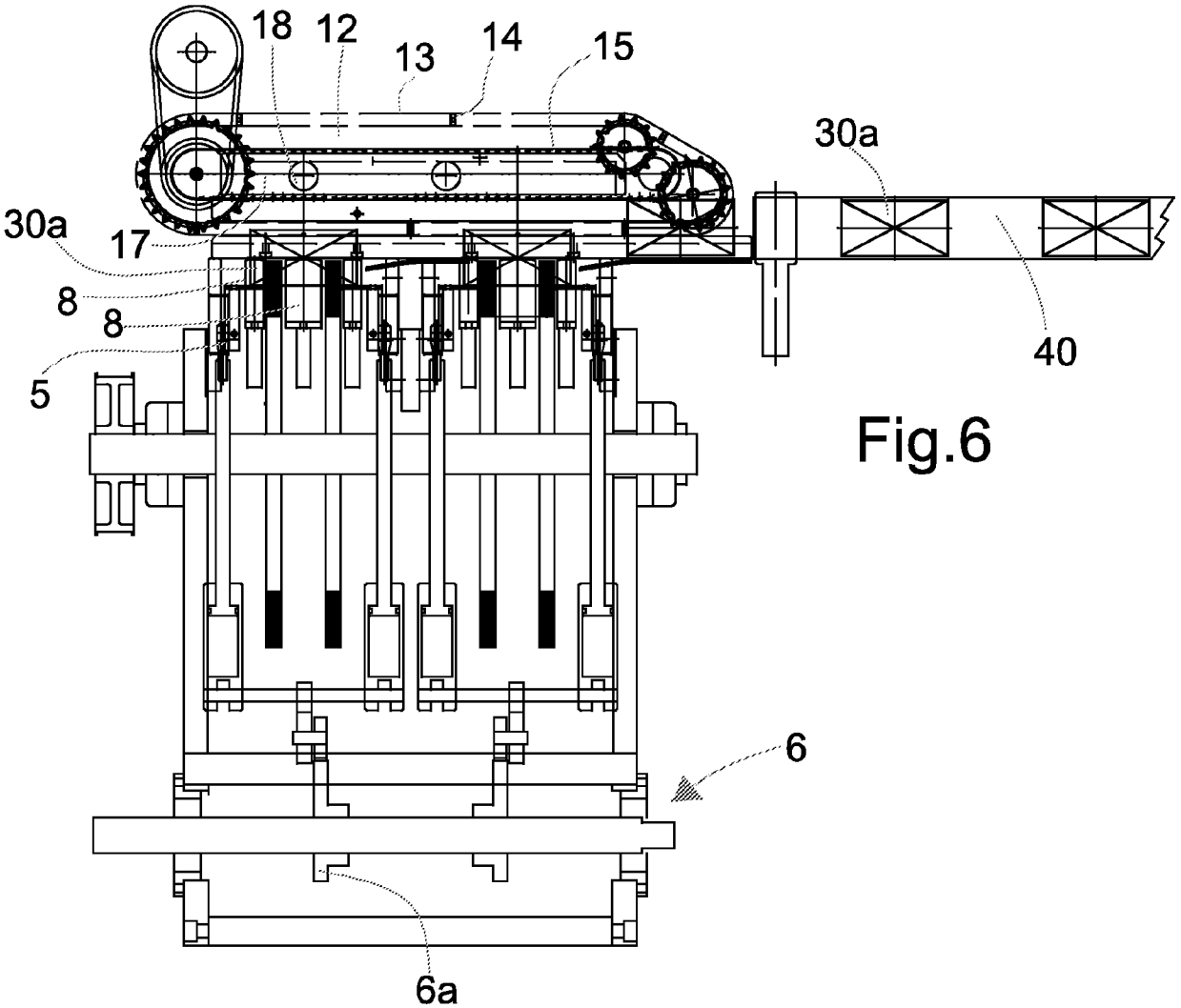
Figure 6A:
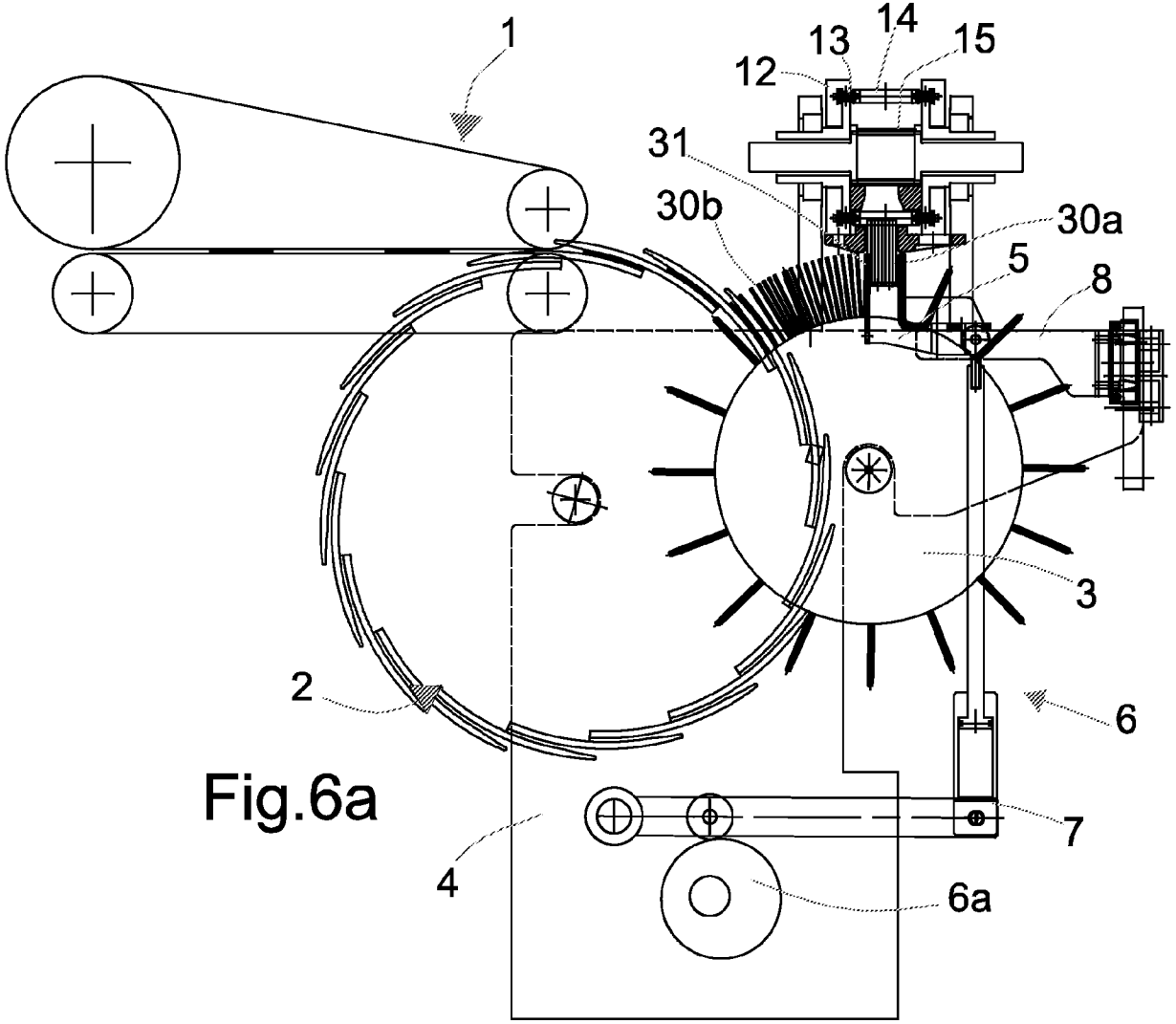
Figure 7:
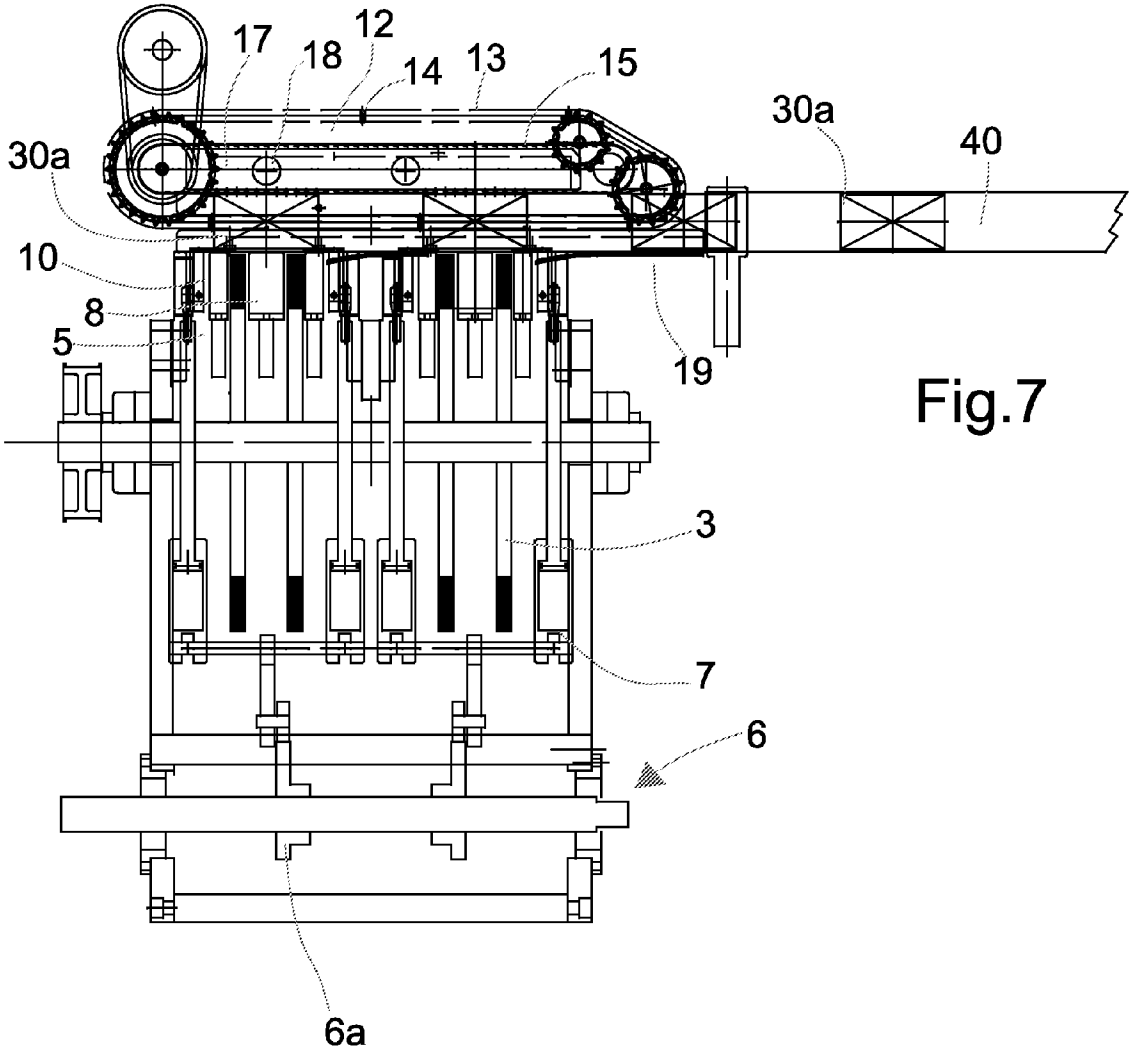
Figure 7A:
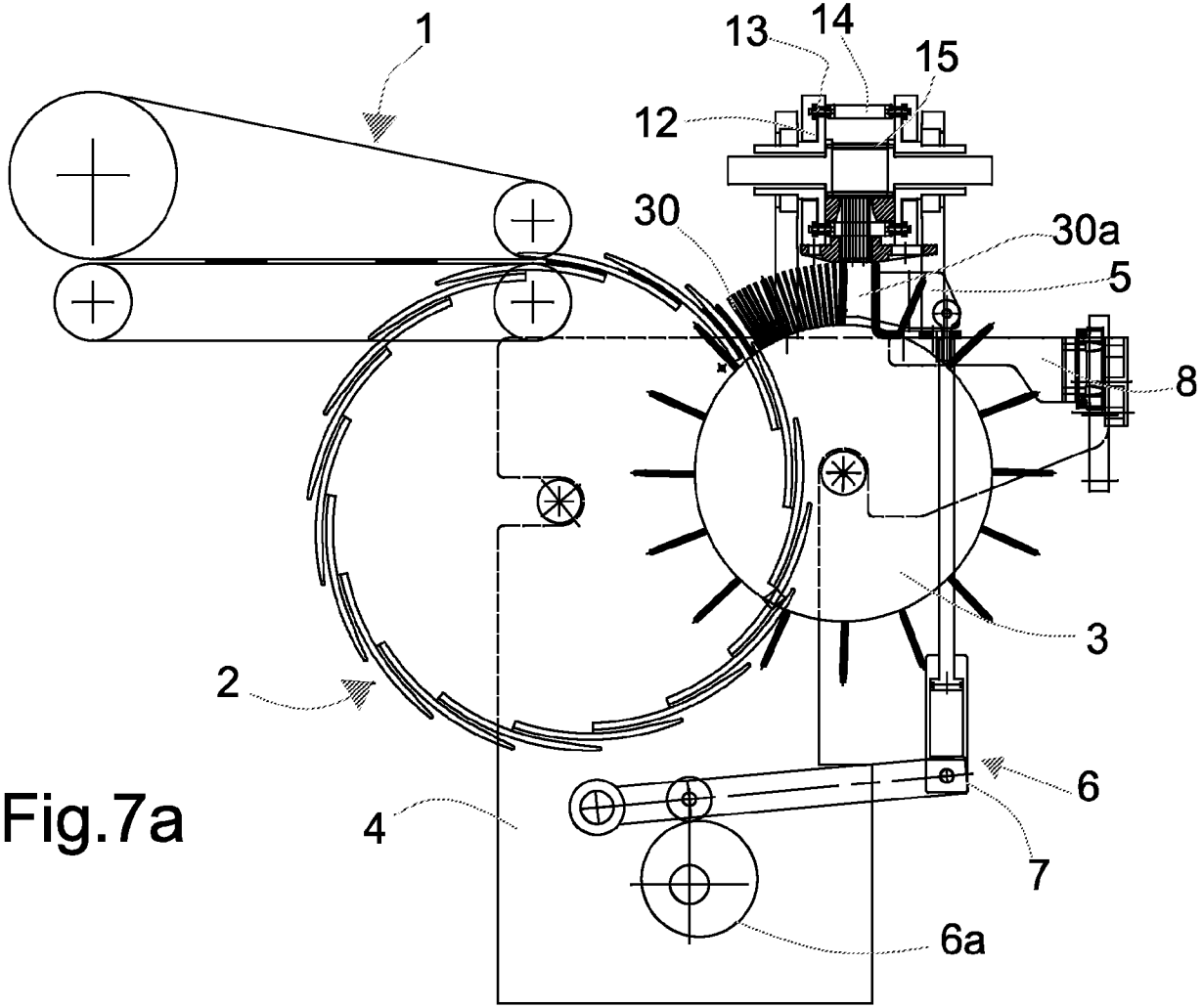

Considering FIG. 6*a*, the pushing members 5*a* of the ejection devices 5 start the ejection step of the formed stack, without contacting the adjacent and subsequent product stacks 30*b*, thanks to the width of the separating blades 31, and taking into account that, as mentioned, at this stage the separating wheels are substantially still. In the step of FIG. 7*a*, the pushing members 5*a* complete the ejection. At this point (FIG. 8*a*) the pushing members 5, with an abrupt acceleration commanded by the cam profile which they contact, reach back the initial position, and the separating wheels accelerate to regain the synchronization speed with the collecting discs 2, and consequently bringing the blades 31 of the wheels 3 in phase with the pockets of the discs 2, in order to separate the product in stacks without deforming the folded paper sheets.

It is worth noting how the front face of the pushing members, contacting the product stack 30*a*, does not cause any deformations or withdrawals of the same stack as the member returns back to the rest position, because the radial displacement tends to compress the stacks towards the support surface of the separating wheels 3.

Figure 9:
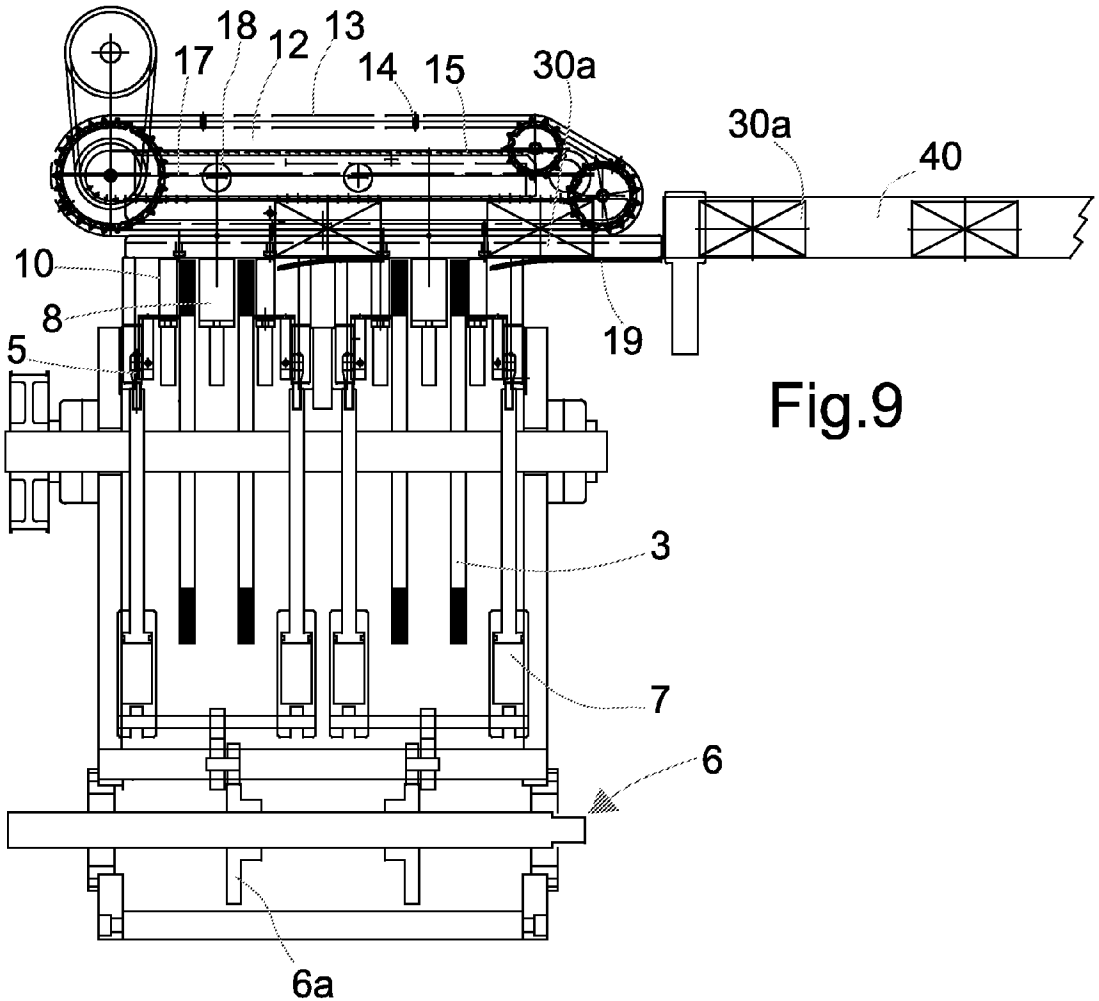
Figure 9A:
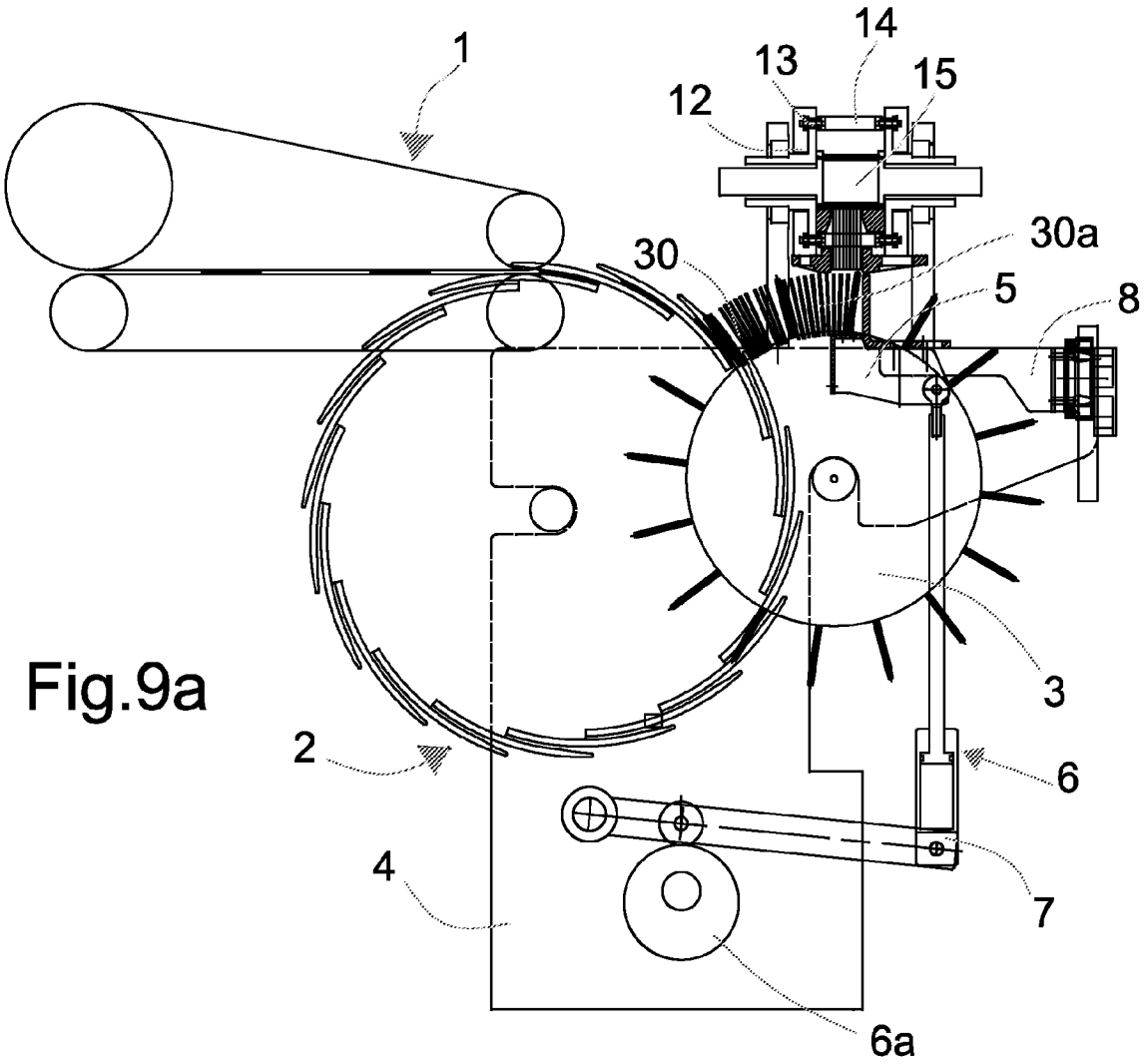

In the stage of FIG. 9*a* the separating wheels and the blades 31, having reached a synchronous speed with the collecting discs, can carry out the separation of the product in stacks, with the pushing members 5*a* still in the retracted rest position, allowing for the formation of a new product stack in a relative separation housing. A new deceleration of the separating wheels 3, at a programmed speed depending on the number of pieces in the stack, creates again the initial situation above for a new stack to be ejected (FIG. 10*a*). At this point the system is ready for a new cycle; the functional steps described above are clearly carried out at high speed, in a continuous and reliable manner.

The bracket 8 and the stop members 9 have the function of setting the size of the containment recess 10 and creating an abutment for the stack under formation during the working steps in which the blades 31 are not in contact, on the downstream side, with the product stack being ejected (FIGS. 5*a*, 6*a*, 10*a*). The actuator 11 can indeed remove such abutment, so that the stack can exit at a side of the wheels 3 (emergency work mode, described in detail hereafter).

Considering now the transfer of the stacks to the packaging machine, via the feeding belts 40, with reference in particular to the FIGS. 5 to 10, the pair of chains 13, provided with the crosspieces 14, along with the belt 15 having suction holes 16 (ensuring that the stacks are orderly kept in a vertical position), enters into engagement with the ejected stacks (FIGS. 7*e* 7*a*) and becomes in charge of the transport through mechanical push, and suction, with the further assistance of the linear guides 20 (in the longitudinal direction) and 19 (n the vertical direction), up to the feeding belts 40, the stacks being supported even when the effect of the suction from the belt 15 ceases. The common drive by means of the transmission 21 is such to coordinate the position of the crosspieces 14 with that of the holes 16 of the belt 15. The stack receiving position corresponds to the top run end position of the ejecting members 5*a*; at this stage the stack is compressed against the belt 15 so that the maximum adherence to the same is assured.

It will be apparent that the coordination between the various driving systems is such that no mechanical interference occurs between the ejecting pushing members 5*a* and the crosspieces 14, and also that the stacks being delivered from the ejection system may interfere with the products previously ejected and being transported to the outlet to the packaging machine.

The previously ejected stacks reach then the feeding belts 40, the speed of the chains 13, of the belt 15 and of the same belts being synchronized with the motors M2, M4. As mentioned, the thrusting crosspieces 14 disengage without causing deformations to the stacks, although maintaining the maximum precision as far as the position of the stack is concerned when passing from the chains 13 to the belts 40, even at high speed. The belts 40 then provide for keeping the stack compressed and orderly during the feeding transport to the packaging machine.

Figure 11:
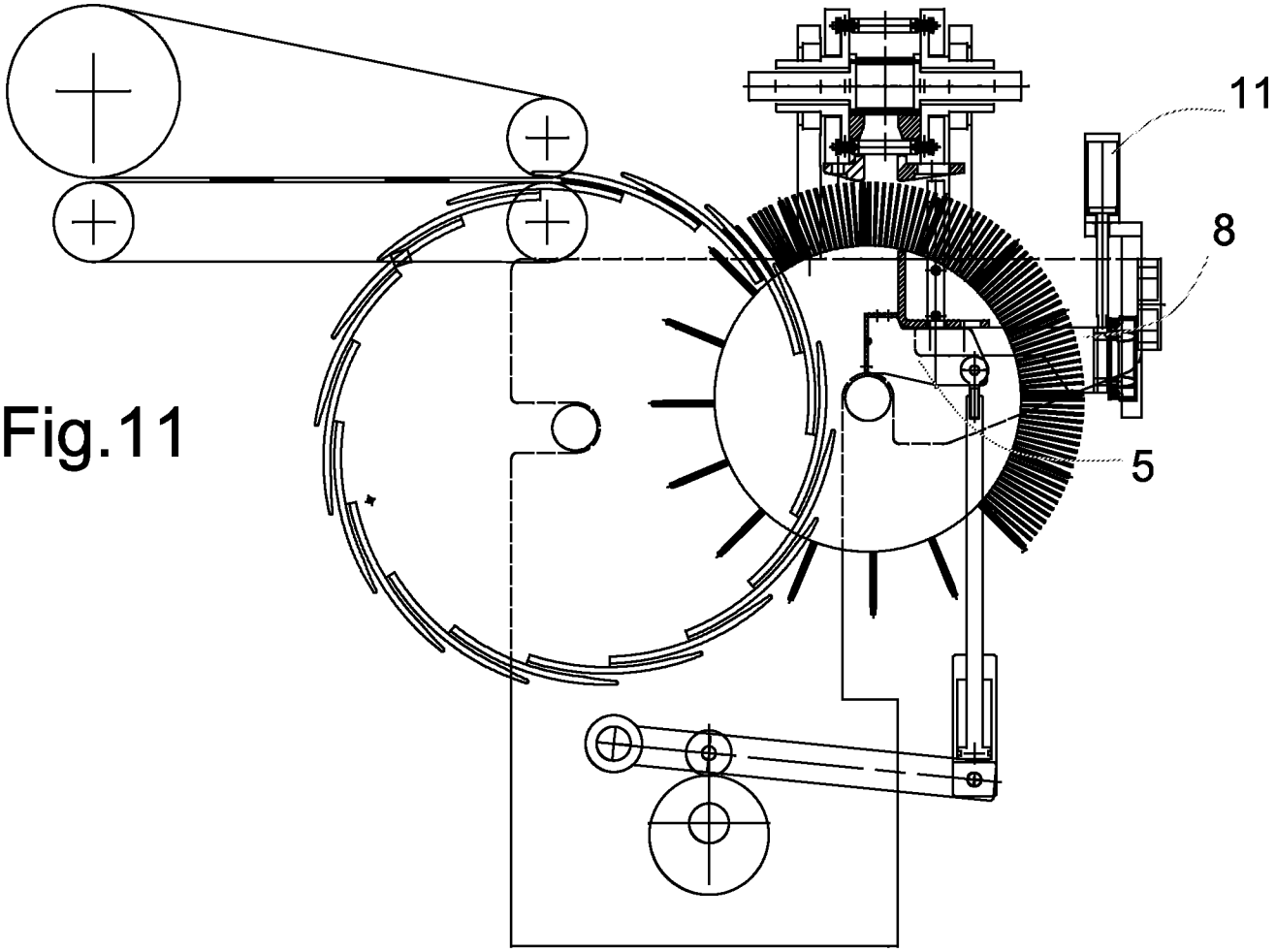
FIG. 11 is again a side view of the same apparatus in a product outlet step, in case of emergency or jams in one of the devices operatively linked according to the invention.
Figure 12:
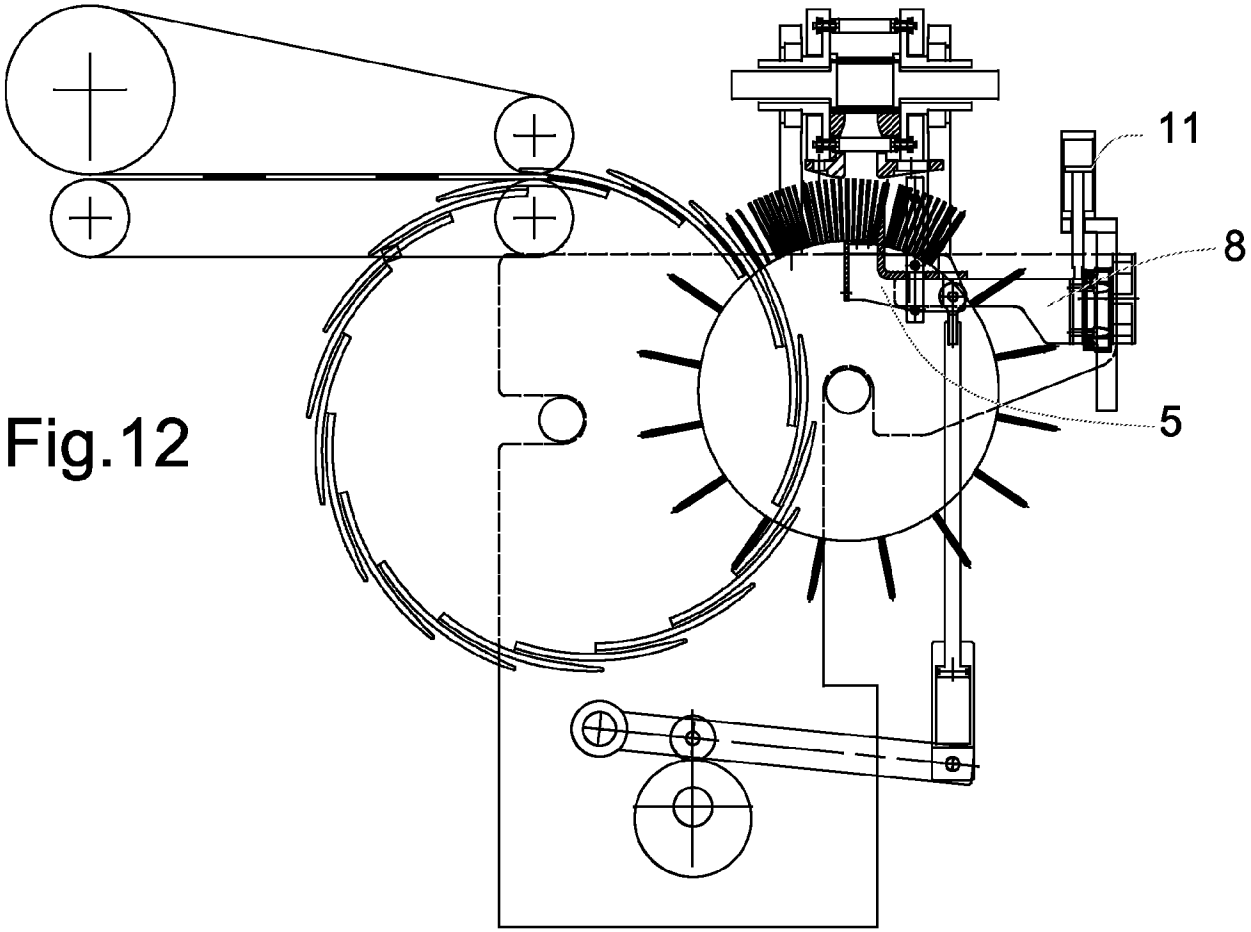
FIG. 12 is a side view as in FIG. 11, in a running order restore step from the emergency conditions.

The provision of a safety device in the product ejection system, for reacting to possible malfunctions and remedying thereto, has been already mentioned. With particular reference to the FIGS. 11 and 12, FIG. 11 represents indeed an emergency condition in which, further to a jam during the formation of the stack, or during the transport with the belt 40, or even in the packaging machine downstream, e.g. caused by defects in the single article, the necessity arises for stopping the product feed to the packaging machine. To this purpose, by means of the pneumatic actuator 11, the bracket 8 with the stop members 9 is displaced to a disengagement position. As a consequence, the product stop effect is removed and the stacks can freely overcome the ejection area, bypassing the transport to the packaging machine to be removed from the separating wheels at the front, without causing further problems.

At the same time, the unlocking system 7 of the ejection devices 5, essentially formed, in turn, by linear actuators arranged along the rod closet o the pivotal connection point with the crank, is activated. Accordingly, such actuators reduce the length of the rods and in this way the pushing ejection devices 5 are radially driven back, out of the ejection area so that they become out of order.

A possible jam, in order to consequently switch on the actuators, is detected through known sensor means, not shown, e.g. photo sensors.

FIG. 12 represents instead the restoring from the emergency condition, and it can be noticed that, having the actuators 11 and 7 been driven in the opposite manner than the previously mentioned circumstances, the system has practically again the normal work configuration of the previous figures and relative description. The restoring is controlled taking into account the synchrony with the other devices of the apparatus, and it can therefore be carried out at high speed, ensuring immediately the full working performance.

With reference now to FIGS. 13 to 18, according to a different embodiment of the invention, a set of collecting discs 2' and separating wheels 3' is arranged and works as already described. Also the structure and operation of the ejection system 5' with safety unlocking device 7' are analogous to the first embodiment previously described, and will not be described again in detail. However, in this embodiment, the direction of ejection, and consequently the arrangement of the ejection system 5', is horizontal and namely, in the depicted example, diametrically opposite the area of cooperation between the collecting discs 2' and the separating wheels 3'.

The movable bracket 8' with the stop members 9' (visible in particular in FIG. 18), in order to exert an abutment and a compression on the stacks in the ejection position, is in turn analogous to that of the first embodiment, being it in this case driven by a reciprocating driving arm 81' (with which the safety unlock actuator 11 is integrated) controlled—as explained soon hereafter—by a cam device 65' to adjust the position of the same device 8' in the stack forming step.

Figure 13:
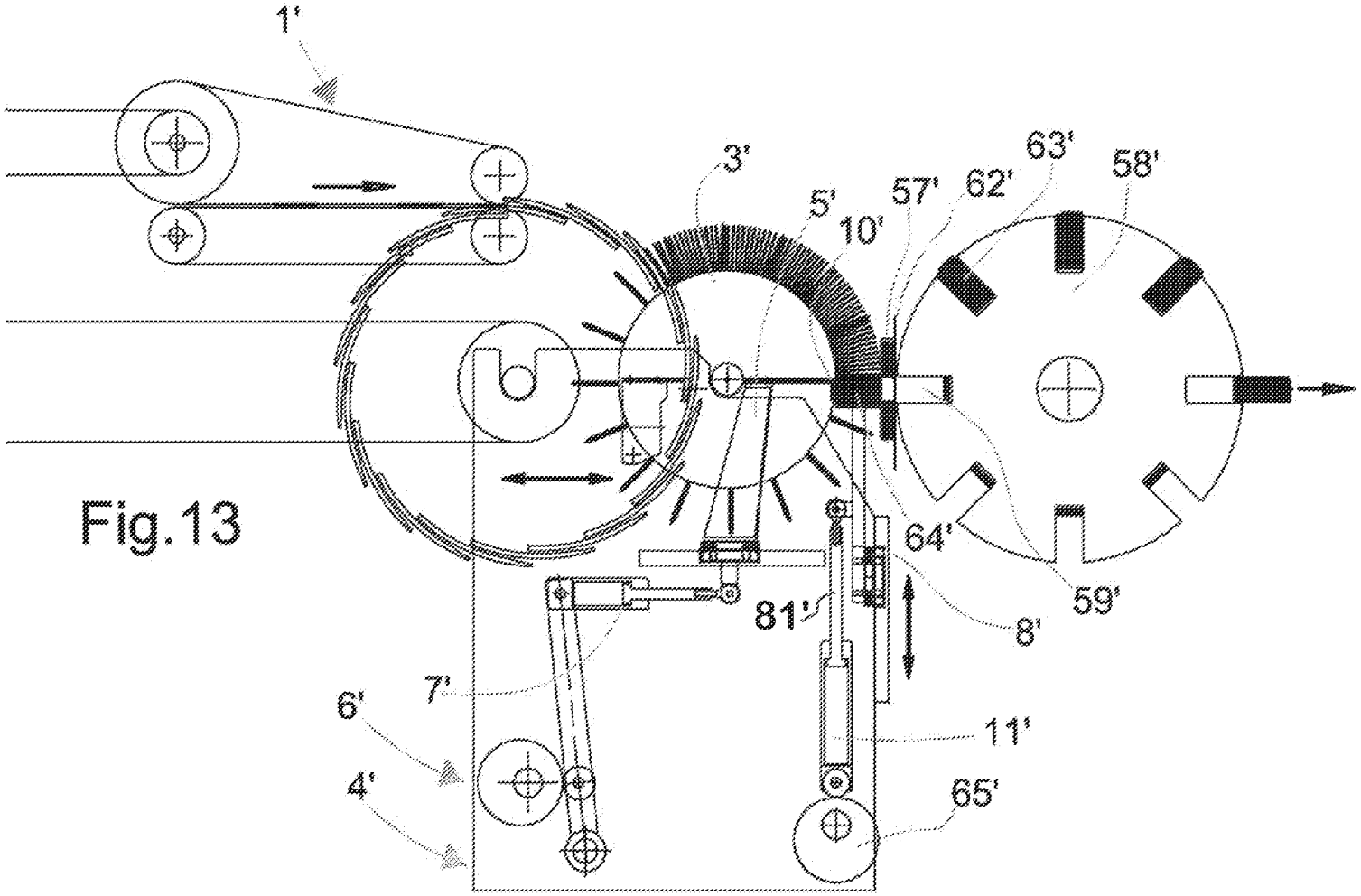
FIG. 13 shows a schematic side view of a feeding apparatus according to the invention, in a second embodiment, associated with a packaging device.

In this embodiment the apparatus according to the invention feeds directly a packaging drum 58', of a type known as such, revolving in turn around an axis parallel with the rotation axes of the discs 2' and of the wheels 3'. The drum 58' is provided with radial pockets 59' in which the product stacks are inserted with the interposition of a packaging film sheet 62', as common practice in the field. The known film cutting and feeding system is not shown In greater detail, FIG. 13 shows also and in particular a pair of guide bars 57' for guiding the product between the ejection and the insertion in a respective pocket 59' of the packaging drum 58'. The bars 57' are equally spaced from a central ejection plane, here indicated with 54', and are adjustable in height depending on the product to be packaged. A formed stack of product in a containment recess 10' of the separating wheels 3', in an ejection step, is indicated with 64'.

Figure 14:
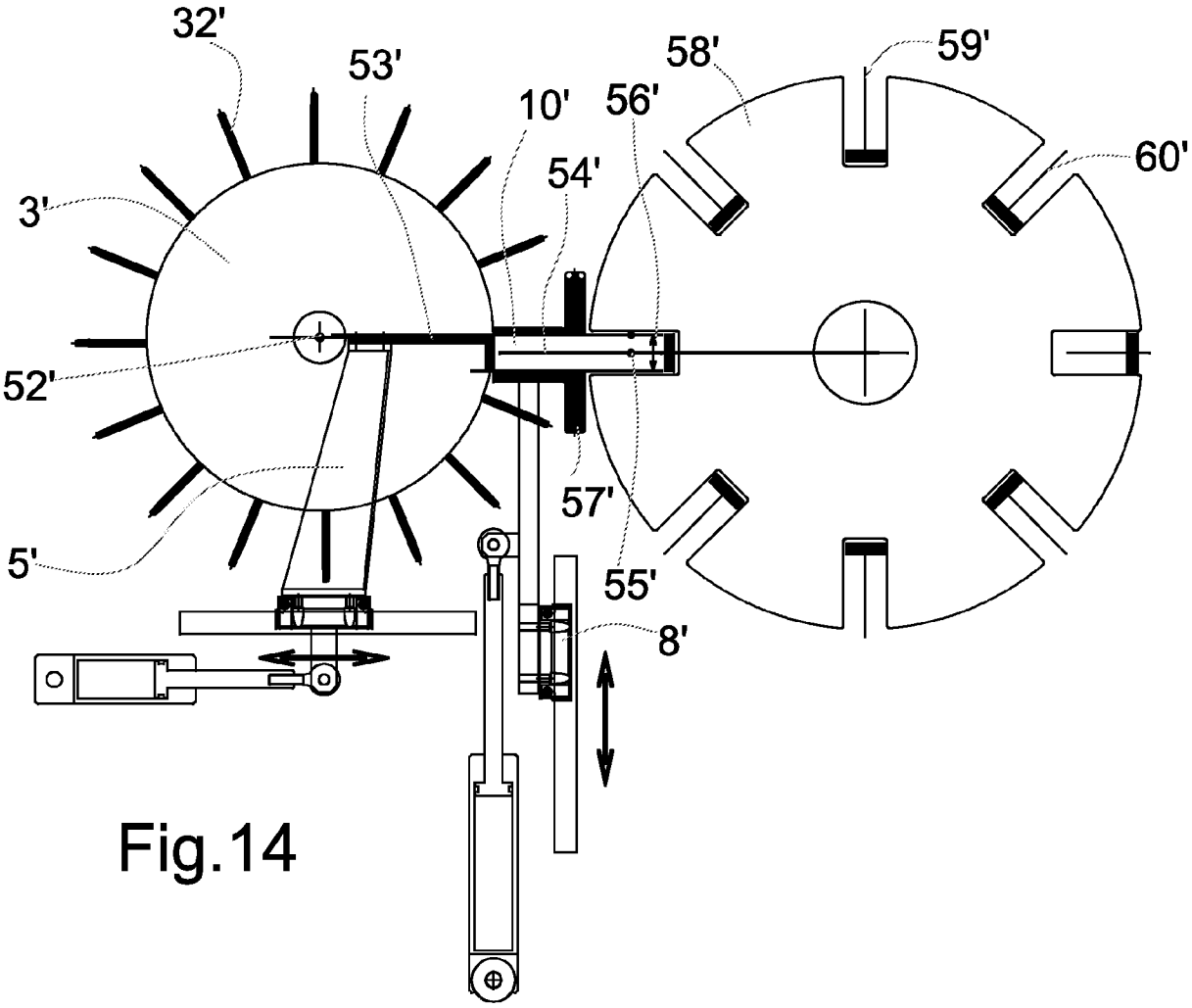
FIGS. 14, 14*a* and 14*b* show the apparatus of FIG. 13 respectively in a side view, with the packaging device, in an exploded front view and in an assembled front view representing the separating wheels and the components associated thereto.
Figure 14B:
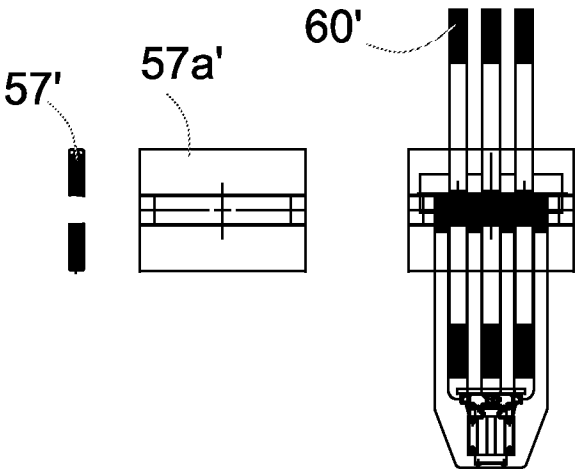
Figure 14A:
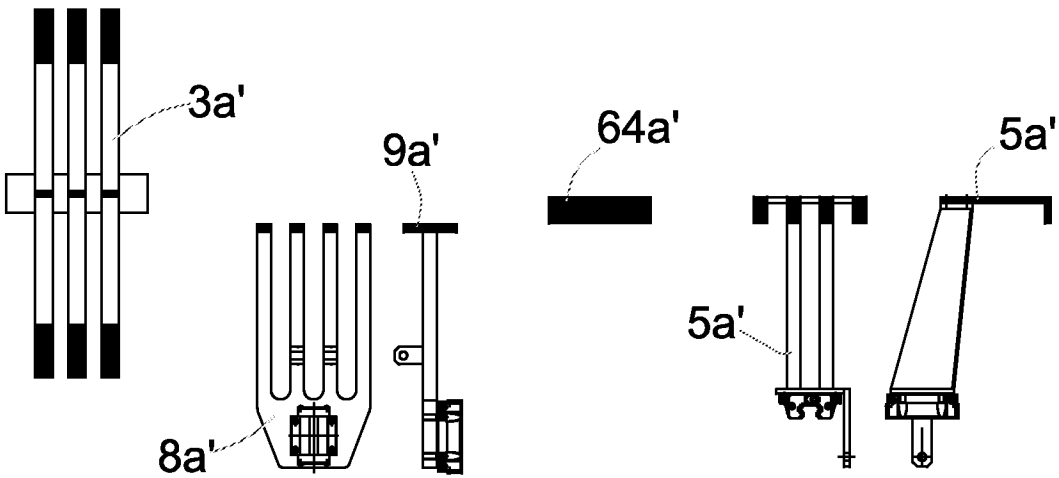
Figure 15:
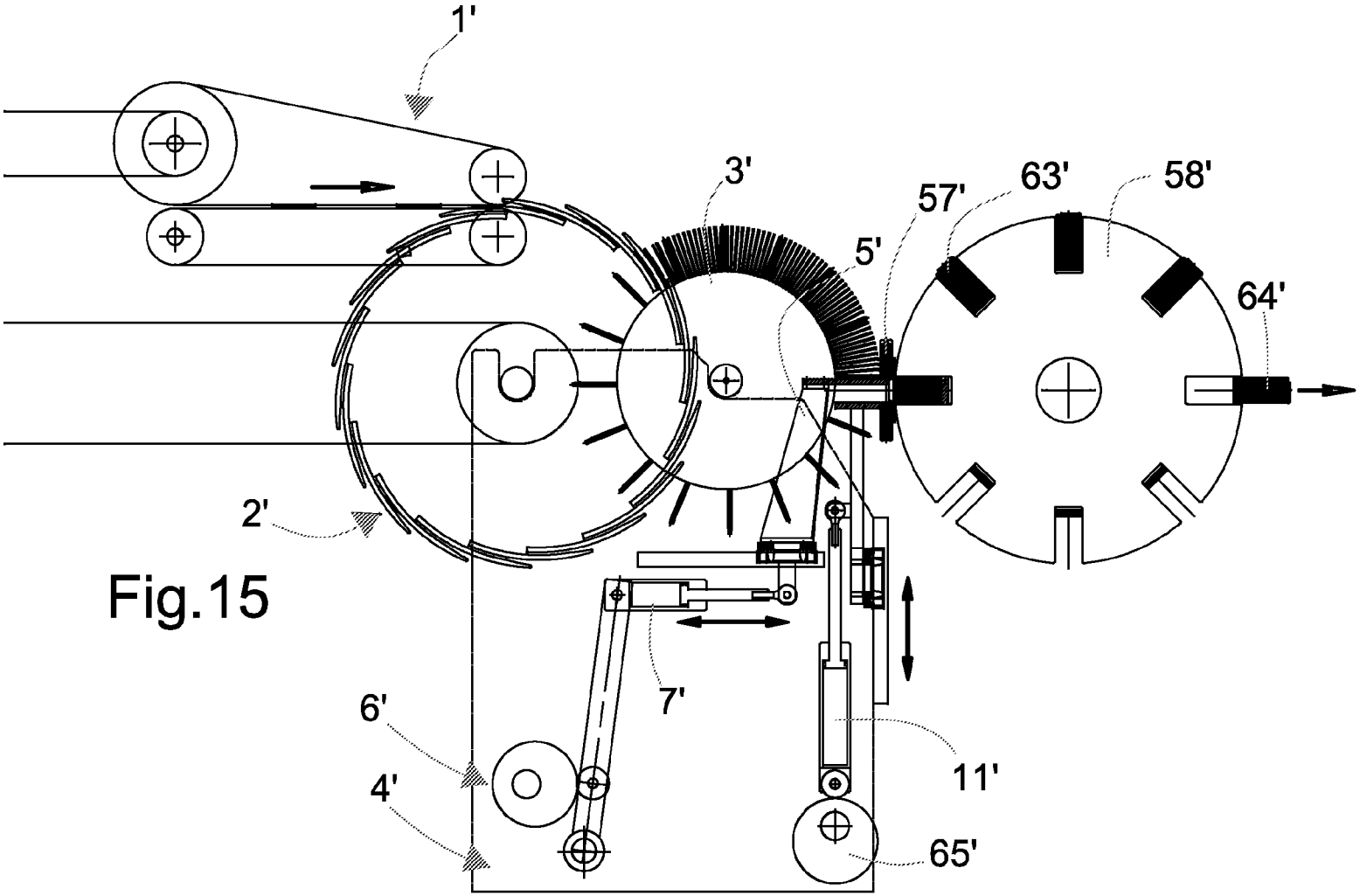
FIGS. 15 to 18 again show schematic side views, like in FIG. 13, of the apparatus in the second embodiment, in different and subsequent product advancement steps.
Figure 16:
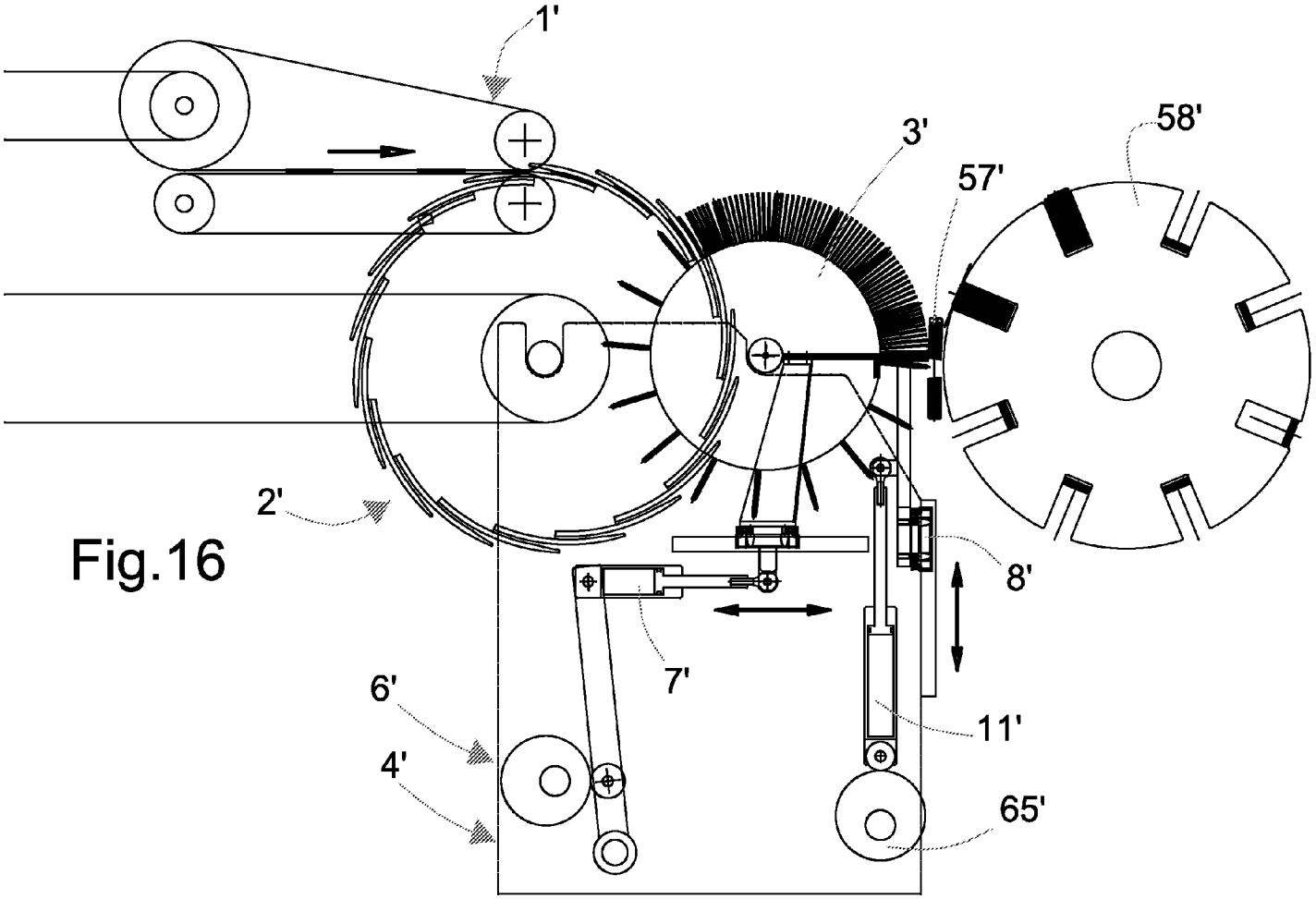

Then, in FIGS. 14 and 14*a* it can be noticed in particular a shaft 52' supporting the separating wheels, and a plane 53' corresponding to the plane on which the separating blades 31' become arranged in the stack ejection step, delimiting on top the recess 10'. Such a plane is off-centered with respect to the axis of the drum 58', in a variable manner as a function of the geometrical characteristics of the assembly (diameter of the separating wheels 3' and of the collecting discs 2' related with the side of the product), so as to allow for the correct formation of the stacks.

The axis of the drum 58' lies over the above mentioned central ejection plane 54', and is in the median point, when considered along a tangential direction, with respect to the height of the product and of the containment recess 10'. The distance indicated with 55' represents indeed the off-centering distance between the plane 54' and the plane 53', and corresponds to half the width, measured tangentially, of a stack containment recess 10', the latter width being indicated with 56' and being substantially equal to the height of a packaging pocket of the drum 58'.

In the pockets 59' of the packaging drum 58' extraction devices 60' are arranged, depicted schematically and working in accordance with known techniques. The FIGS. 14*a* and 14*b*, front views of the basic components of the system, show then in particular the separating wheels 3' with blades 31', ejection pushing members 5*a*', product guide bars 57', a product stack 64' and a bracket 8'.

In operation, with particular reference now to the FIGS. 15 to 18, FIG. 15 shows the step of insertion of the product stacks in the packaging drum 58' synchronized with the separating wheels and having a step by step motion, remaining at rest for each ejection cycle until the stack is completely inserted.

In this step the separating wheels 3' reach the minimum speed as described for the previous embodiment and a product stack, here indicated with 64', with the interposition of the film sheet 62' has been inserted in a pocket 59' of the packaging drum 58'.

The device 8' (FIG. 16) with its stop members starts a vertical motion until it reaches a top run end position coinciding with a top plane of the pocket 59' and contacting the stack indicated with 30'. The blades of the separating wheels overcome the ejection device 5' without colliding with it.

The separating wheels 3' keep on rotating, and the ejection device carries out an abrupt backward movement returning to the start position, without interfering with the stop members 9'; the packaging drum 58' starts to change its position.

Figure 17:
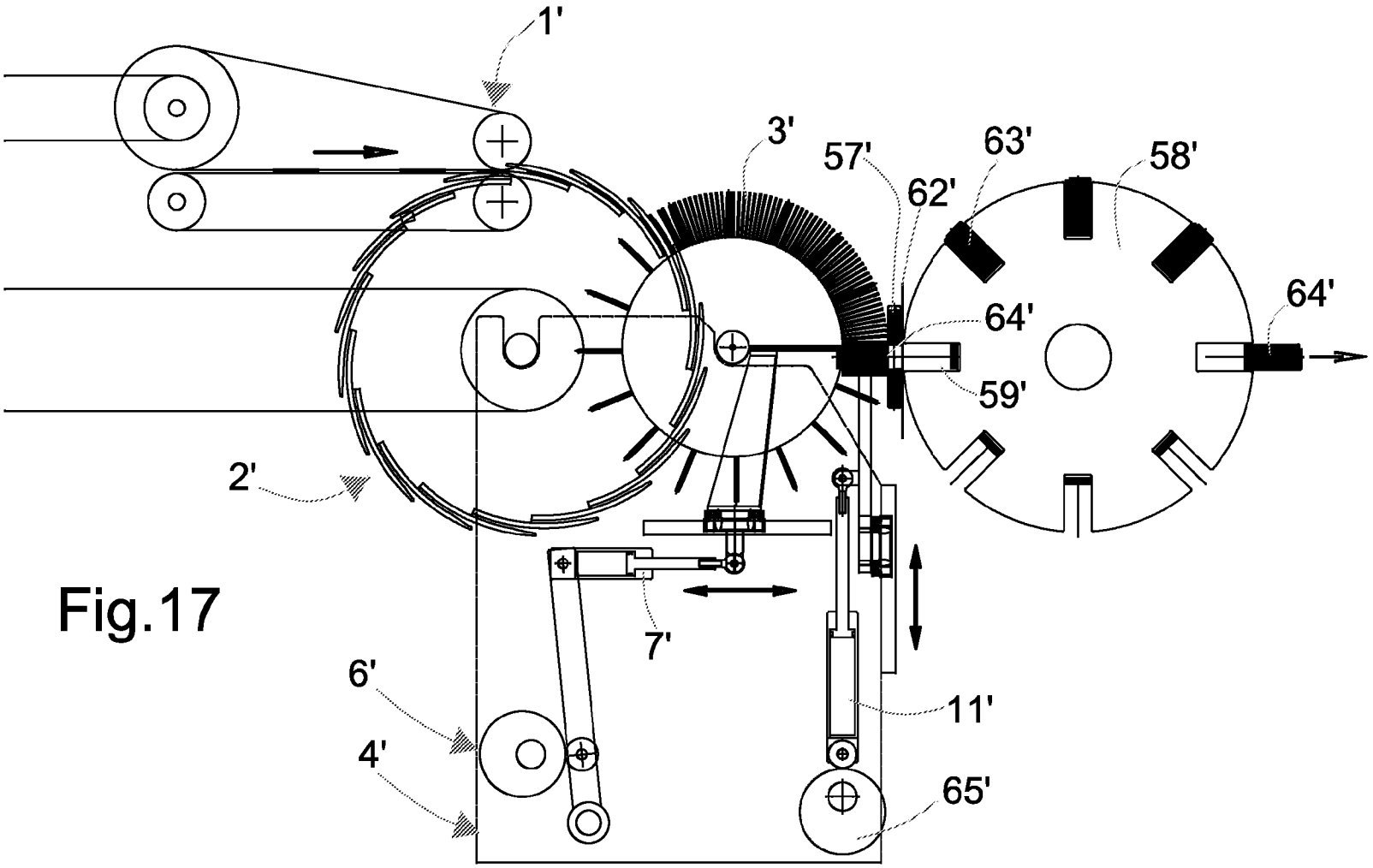

From FIG. 17 it can be noticed that the separating wheels 3' have completed the separation of the stack. The device 5' is in a rest position, while the device 8' with the stop members 9' performs a descending vertical motion until reaching the initial position. It is also to be noted that the stack is compressed between the blades 31' and the stop members 9', that take on the stack to the ejected position In this condition the stack 30' being compressed is supported in the correct position, with reference to the blades, tank to a descent movement of the device 8', and consequently of the stop members 9', controlled via the cam 65', designed so as to compress the stack gradually until it has the established height before the ejection. Such a mobile control is in this case necessary due to the different arrangement of the product and the consequent possible fall by gravity force. The ejection is then performed by the device 5' substantially as in the first embodiment, with however also the stabilizing assistance of the bars 57', keeping the stack 30' in the correct geometry during ejection until the insertion in the packaging pocket of the drum 58' is completed.

Figure 8:
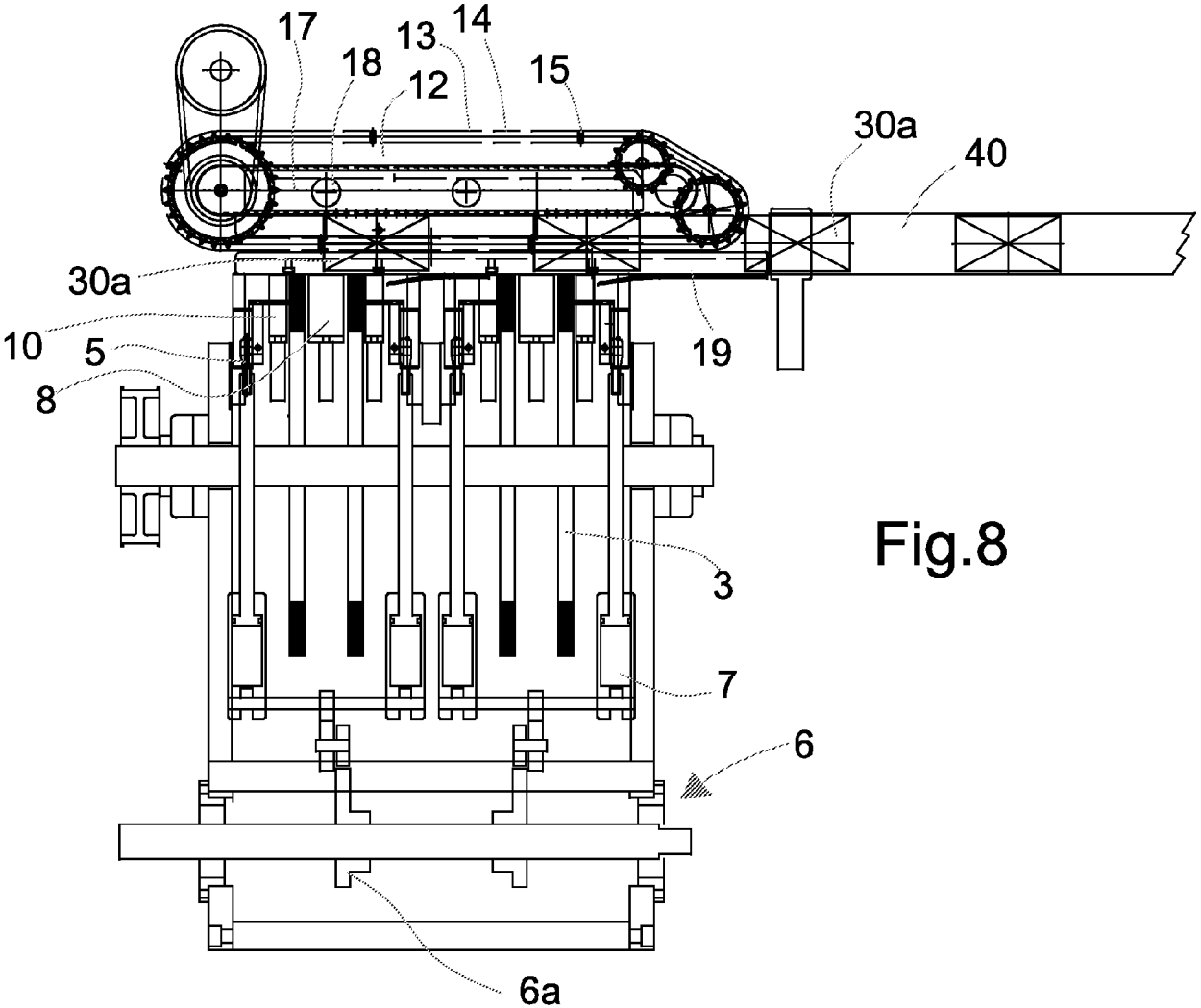
Figure 8A:
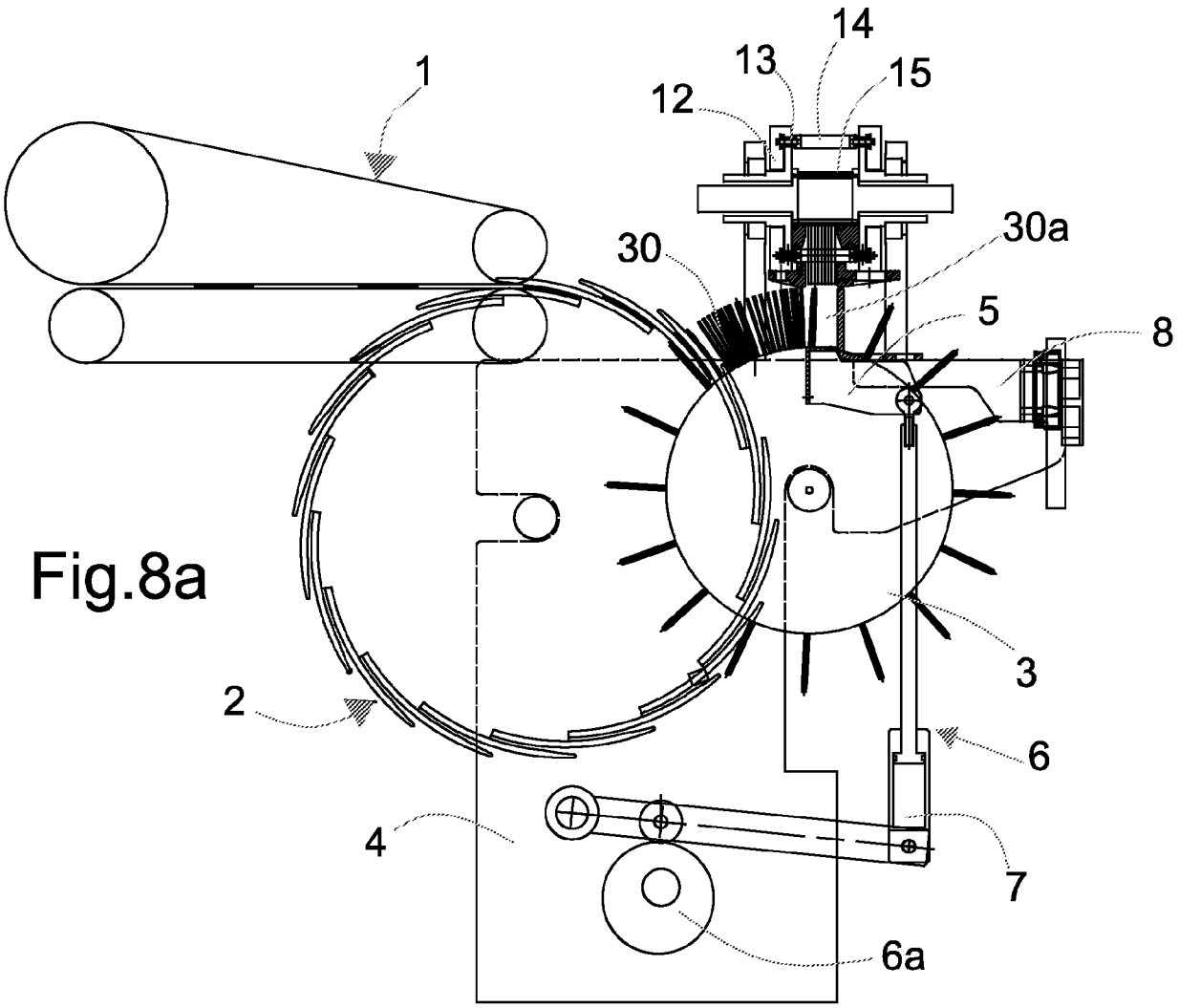

Also in this case the number of wheels 3', pushing members 5*a*' and stop members 9' are variable as a function of the product to be packaged, and arranged so as not to mutually interfere (e.g. as shown in FIGS. 5*a* and 8*a*).

Figure 18:
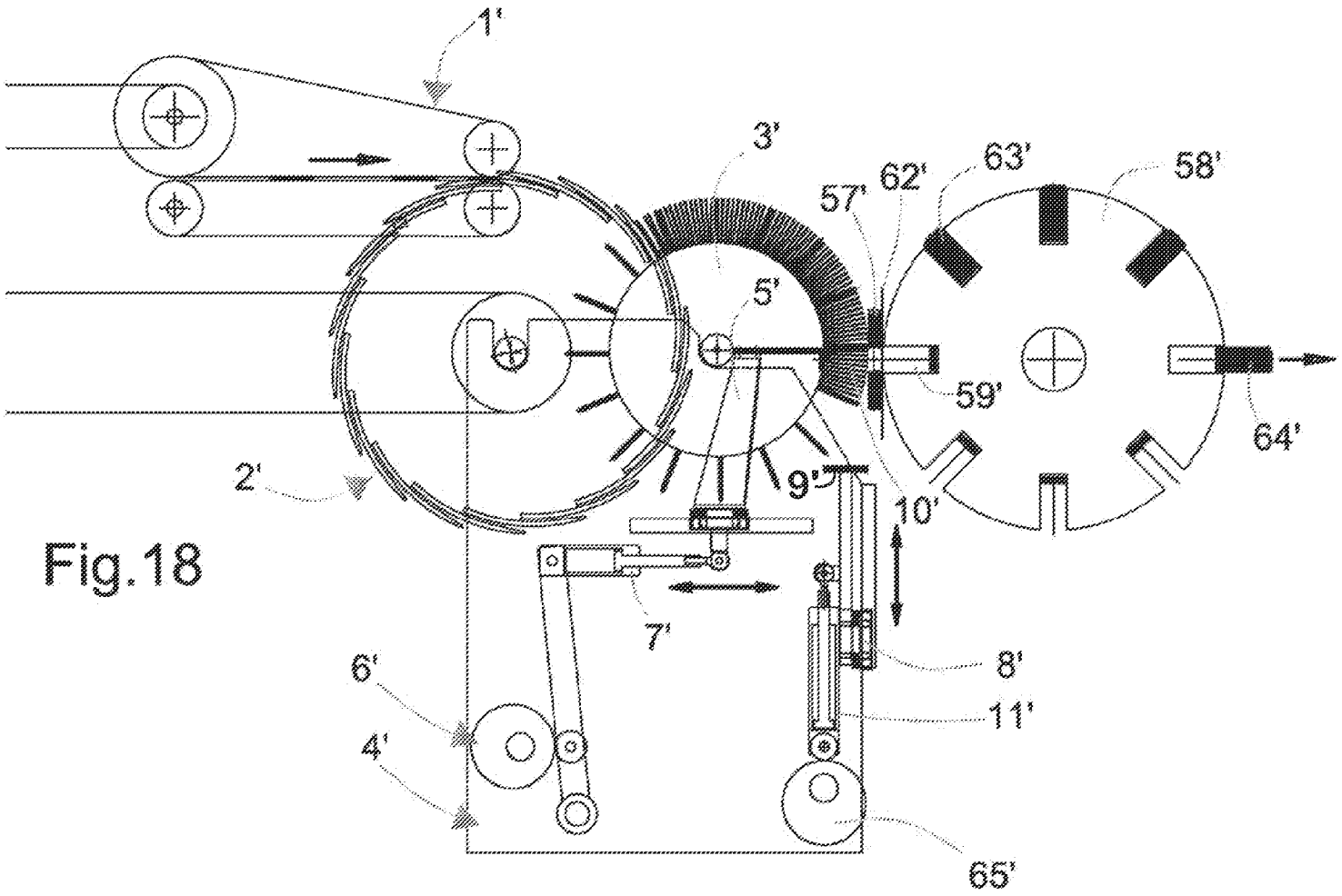

Finally, in FIG. 18 there is shown the apparatus in emergency condition, with the packaging drum 58' at rest, the separating wheels 3' that keep on rotating, but the ejection device and the stop device unlocked respectively thanks to the actuator 7' and the actuator 11'. The product stacks are not then inserted in the drum 58' and can exit at the lower side of the separating wheels, in the area indicated with 66'.

Generally speaking, the construction ad operation of the ejection means 5, 5', having according to the invention a reciprocating motion component in the radial direction, in cooperation with the stop means operating on the downstream side of the stack and that assist the complete formation and the transport of the same (such stop means being independent and adjustable with respect to the ejection means), ensure an effectiveness and a precision (stack size control) unachieved by known systems. The invention also permits to obtain a vertically oriented outlet of the product (first embodiment), with subsequent conveyance to a single transport line, for a plurality of side by side workflow channels, and an advantageous fast-actuation emergency unload in case of product jams.

The spatial references vertical/horizontal used above are clearly intended in connection with the most typical working arrangement and with the orientation shown in the figures, although it is as clear that these reference should not be considered at all as limitative.

The present invention has been described so far with reference to some preferred embodiments thereof. It will be understood that other embodiments are encompassed by the inventive scope of protection defined by the attached claims.

The invention claimed is:

1. An apparatus for feeding tissues or similar folded paper articles to an automatic packaging system, the apparatus comprising:

means for forming stacks of articles on one or more sets of separating wheels provided with radial blades, each set being formed by two or more wheels, feeding means for feeding the stacks from the separating wheels to said packaging system, wherein said feeding means comprise for each set at least one ejection device with at least two pushing members, at least one of the pushing members being inserted between two adjacent ones of the wheels, and the pushing members being movable with a motion having a reciprocating component along an ejection direction, and an article stop element for engaging with said stacks on said wheels at least in a step preliminary to the ejection, said article stop element being operatively independent from said ejection device, and adjustable along a stop direction, substantially tangential with the separating wheels and orthogonal with the ejection direction.

2. The apparatus according to claim 1, wherein said at least two pushing members reciprocate in a radial direction of said separating wheels, controlled by a rod and crank control device driven, on the crank, through a cam device.

3. The apparatus according to claim 2, wherein said cam device are provided by a drive camshaft shared by a plurality of side by side sets of separating wheels.

4. The apparatus according to claim 2, wherein said article stop element comprise a bracket arranged tangentially to said wheels, and a plurality of stop members mounted on said bracket and projecting orthogonally with the same, so as to define a stack containment recess adapted to result substantially parallel with a rank of said blades during the ejection step of a stack from said separating wheels, the position of said stop members being adjustable along the longitudinal direction of the bracket.

5. The apparatus according to claim 4, comprising an emergency unlocking system acting on said control device and on said bracket for fast disengagement of said pushing members and said stop members from said article stacks.

6. The apparatus according to claim 5, wherein said emergency unlocking system comprises a linear actuator adapted, respectively, to reduce a rod length of said rod and crank control device making said pushing members radially retract to a rest position and consequently free the ejection area, and to displace said bracket according to a direction parallel with the ejection direction.

7. The apparatus according to claim 2, wherein said ejection direction is substantially horizontal, said article stop element comprising stop members defining a stack containment recess adapted to result substantially parallel with a rank of said blades during the ejection step of a stack from said separating wheels, said stop members being movable in a reciprocating fashion according to a direction orthogonal with said ejection direction so that said stop members gradually compress the stack until an established height is reached before the ejection.

8. The apparatus according to claim 7, wherein said stop members are integral with a movable bracket controlled by a reciprocating arm driven through cam means.

9. The apparatus according to claim 8, comprising an emergency unlocking system acting on said control device and on said bracket for fast disengagement of said pushing members and said stop members from said article stacks.

10. The apparatus according to claim 9, wherein said emergency unlocking system comprises a linear actuator adapted, respectively, to reduce the rod length of said rod and crank control device making said pushing members radially retract to a rest position and consequently free the ejection area, and to reduce the length of said reciprocating arm.

11. The apparatus according to claim 1, wherein said ejection direction is substantially vertical, the apparatus comprising a transport system for transporting the stacks ejected by said ejection means to the automatic packaging system downstream, said transport system being arranged above said one or more sets of separating wheels and extending horizontally along an outlet feeding direction parallel with the rotation axis of the separating wheels.

12. The apparatus according to claim 11, wherein the transport system comprises an endless loop chain carrying cross-pieces adapted to mechanically urge the stacks, and a conveyor belt associated with pneumatic means, for holding the product stacks at least on a top side, keeping the stacks in adhesion to the conveyor belt along the run in said outlet feeding direction.

13. The apparatus according to claim 7, comprising or associable to a packaging drum, in turn revolving around an axis parallel with the rotation axis of said wheels and provided with radial pockets in which the product stacks are inserted with the interposition of a packaging film sheet, the apparatus further comprising a pair of guide bars for guiding said stacks, said bars being arranged between said wheels and said drum for guiding each stack in a respective pocket of the packaging drum, said bars being equally spaced from a horizontal plane passing through the rotation axis of the drum, and being adjustable in height.

14. The apparatus according to claim 13, wherein said separating blades are adapted to take on a horizontal configuration on a plane spaced above said horizontal plane passing through the axis of the drum, to this purpose the separating wheels being adjustable in height.

15. A method for feeding stacks of tissues or similar folded paper articles to an automatic packaging system, comprising the steps of:

forming the product stacks on one or more sets of separating wheels with radial blades, each set consisting of two or more wheels, ejecting the stacks from said wheels according to a radial ejection direction, and prior to the ejection from said wheels, stopping said stacks by a stop surface in an independent manner from the action of said blades, along a plane parallel with the ejection direction.

16. The method according to claim 15, wherein during at least part of the step of ejecting said stacks are contained between a rank of blades and said stop surface.

17. The method according to claim 15, wherein the rotation of the separating wheels is variable such that the rotation speed of the separating wheels is reduced during said step of ejecting.

18. The method according to claim 17, wherein said ejection direction is substantially horizontal, the stacks being stopped on a plane which translates in a reciprocating manner along a direction orthogonal with said ejection direction.

19. The method according to claim 15, wherein said ejection direction is substantially vertical, and the method further comprises the step of transporting the ejected stacks along an outlet feeding direction parallel with the rotation axis of the separating wheels.

20. The method according to claim 19, wherein the transport along the outlet feeding direction is carried out with the assistance of a suction hold at least on a top side of the stacks.

* * * * *